US010507949B1

(12) United States Patent
Nunez et al.

(10) Patent No.: US 10,507,949 B1
(45) Date of Patent: Dec. 17, 2019

(54) CONVERTIBLE FOOD CONTAINERS

(71) Applicant: Amazon Technologies, Inc., Seattle, WA (US)

(72) Inventors: Sigifredo Carriedo Nunez, Seattle, WA (US); Gordon Mueller, Edmonds, WA (US); Herman Hou Meng Chan, Seattle, WA (US); Shannon Quek, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 480 days.

(21) Appl. No.: 15/197,724

(22) Filed: Jun. 29, 2016

(51) Int. Cl.

| | |
|---|---|
| ***B65D 5/36*** | (2006.01) |
| ***B65D 5/18*** | (2006.01) |
| ***B65D 5/20*** | (2006.01) |
| ***B65D 5/42*** | (2006.01) |
| ***B31B 47/00*** | (2006.01) |

(52) U.S. Cl.
CPC ..... *B65D 5/3657* (2013.01); *B31B 47/00* (2013.01); *B65D 5/18* (2013.01); *B65D 5/2052* (2013.01); *B65D 5/4204* (2013.01); *B65D 5/4233* (2013.01); *B65D 5/4266* (2013.01); *B31B 2247/00* (2013.01)

(58) Field of Classification Search
CPC ..... B65D 5/3657; B65D 5/18; B65D 5/2052; B65D 5/4204; B65D 5/4233; B65D 5/4266
USPC ..... 229/186
See application file for complete search history.

(56) References Cited

U.S. PATENT DOCUMENTS 2,332,192 A * 10/1943 Becker ..... B65D 5/3657 206/761
3,656,683 A * 4/1972 Desmond ..... B65D 5/2009 229/172
4,260,098 A * 4/1981 Manizza ..... B65D 5/2047 229/114
4,558,815 A * 12/1985 Wischusen, III ..... B65D 5/18 229/112
5,255,841 A * 10/1993 Ritter ..... B65D 5/2047 206/386
5,307,982 A * 5/1994 Swindell ..... B65D 5/46024 229/117.19
5,645,300 A * 7/1997 Hill ..... B65D 75/54 283/101

(Continued)

OTHER PUBLICATIONS

Abhaya Asthana et al., "An Indoor Wireless System for Personalized Shopping Assistance", Proceedings of IEEE Workshop on Mobile Computing Systems and Applications, 1994, pp. 69-74, Publisher: IEEE Computer Society Press.

*Primary Examiner* — Corey N Skurdal
(74) *Attorney, Agent, or Firm* — Athorus, PLLC

(57) ABSTRACT

A container formed from a single piece of cardboard or like materials may double as a plate. The single piece may generally take the form of an oval, and may include a number of panels separated by specifically oriented creases and folds which enable the single piece to be folded into the container, and contain a food product such as a sandwich therein, or unfolded into a plate-like flat surface from which the food product may be eaten by a customer. A frame including a plurality of elbows, pegs or other extensions may be used to form the single piece into a semi-folded state, facilitating processes for preparing or packaging the food product.

11 Claims, 20 Drawing Sheets

(56) References Cited

U.S. PATENT DOCUMENTS

| | | | | |
|---|---|---|---|---|
| 5,839,652 | A * | 11/1998 | Ben-Haim | B65D 5/2047 229/240 |
| 7,870,995 | B1 * | 1/2011 | Kaltman | B65D 5/2047 206/485 |
| 9,505,516 | B2 * | 11/2016 | Hubbard, Jr. | B65D 5/2047 |
| 2014/0263600 | A1 * | 9/2014 | Valencia | B65D 5/244 229/155 |

* cited by examiner

CONVERTIBLE FOOD CONTAINERS

BACKGROUND

Many merchants permit customers to order and purchase prepared foods that are packaged for consumption in one or more alternate locations. For example, a restaurant may provide patrons with unfinished portions of meals that were ordered for consumption on the premises, or permit patrons to order meals "to go," and enable such patrons to depart the restaurant with full or partial portions of such meals, e.g., in bags or boxes. Similarly, many markets, grocery stores, street vendors or like merchants will cook or otherwise prepare foods such as salads, sandwiches or entrees, wrap or envelop the prepared foods in packaging that is typically made of paper, plastic or other, similar materials, and hand the packaged, prepared foods to a customer in exchange for consideration. For Americans who are constantly "on the go," the ability to order prepared foods from any number of sources, and the flexibility to consume such foods in locations of their choice, are essential traits of modern dining experiences that may commonly occur in undefined or unpredictable locations.

Typically, prepared foods that are purchased by customers are presented on a plate (or bowl), or like disposable tableware, or in a container that may entirely or partially enclose the prepared foods therein. Unfortunately, a plate is not a container, and a container is not a plate. For this reason, a customer who desires to consume his or her meal on a plate is required to carefully transport the meal on the plate from a source of the meal to a destination where the meal is to be consumed. Any disturbances or disruptions encountered by the customer while traveling in a vehicle, ascending or descending stairs, or walking along a sidewalk or other passageway may cause some or all of the meal to roll or spill off the plate. Likewise, a customer who purchases his or her meal in a sealable container may usually transport the meal to an intended destination without spilling any of the meal while en route, but must locate a plate, a bowl or other tableware upon his or her arrival.

Several attempts at creating containers in the form of plates, incorporating a plate into a container, or using plates as containers or vice versa, have been previously met with limited success. Occasionally, some customers will choose to eat prepared foods that are packaged in "to go" boxes or other containers made of cardboard, foam or other semi-rigid materials directly from such containers. Some such boxes or containers enable customers to tear off lids or other surfaces and to use the torn-off lids or surfaces as plates. Where prepared foods are presented on a plate of a disposable nature, the plate may be temporarily covered by one or more sheets of plastic or paper, or by a lid that snaps into place and may be removed when the foods are to be consumed. Such solutions, while creative, are unable to surmount a number of limitations or hindrances associated with containers or plates, however. For example, most cardboard boxes or food containers must be formed and dissembled by hand, e.g., by inserting a plurality of extensions into slots or by removing the extensions from such slots. Furthermore, removing one or more panels of a box or a container for use as a plate effectively prevents the box or the container from adequately containing any food product therein in the future. Similarly, plastic containers or plates are, by their very nature, plastic, and are unable to be reshaped or reformed into different objects.

DETAILED DESCRIPTION

Figure 1A:
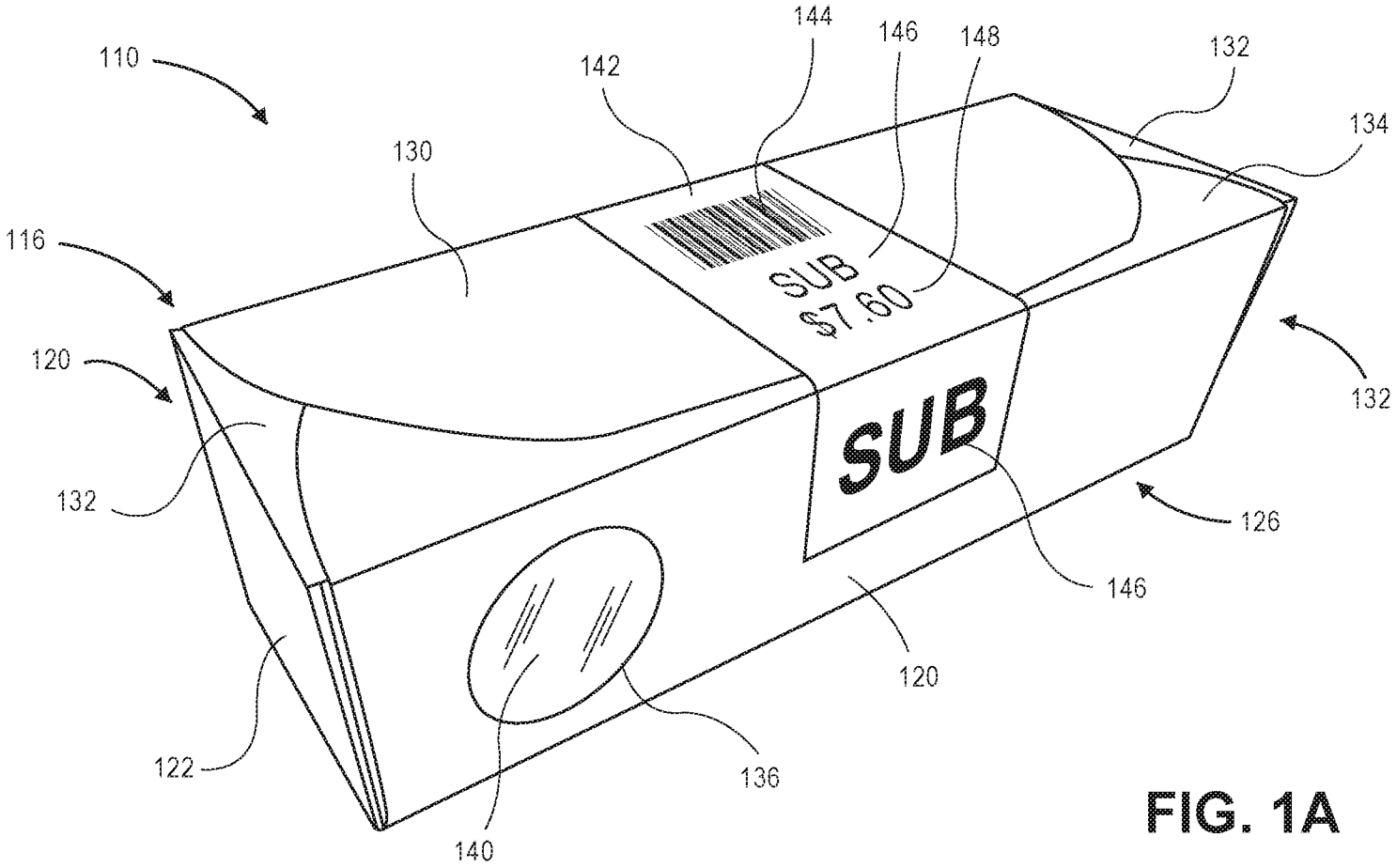
FIGS. 1A through 1E are views of one implementation of a convertible food container in accordance with the present disclosure.

As is set forth in greater detail below, the present disclosure is directed to convertible food containers and plates. More specifically, the present disclosure is directed to food containers that are formed from single pieces or layers of cardboard, paperboard or like materials, e.g., from a single blank, and may be readily converted between an assembled state in which the single blank is folded into a container configured to accommodate one or more food products therein, and a flat state in which the container is folded back into the blank, and able act as a plate or other form of temporary, disposable tableware. In the assembled state, the food containers may be closed by a releasable adhesive or other binding product or agent. The blanks may be prescored with a number of scores or scored lines in locations where the blanks are to be folded into containers, e.g., on specific sides or faces of such blanks, and such scores or scored lines may render containers therefrom naturally inclined to unfold from an assembled state into a flat state, e.g., back into a blank. One or more panels of the blanks may have extended heights which increase the extent of friction urging containers, when formed therefrom, to remain in assembled states when the containers are so assembled. Additionally, a blank may be formed into the assembled state using a set of frames that are specifically arranged and sized to accommodate a blank, and to urge the blank into a semi-folded condition.

Referring to FIGS. 1A through 1E, one implementation of a convertible food container 110 of the present disclosure is shown. The food container 110 is formed from a single-piece blank 115 that comprises a pair of side panels 120, a pair of end panels 122 and a bottom panel 126. When the blank 115 is folded into the container 110, the side panels 120, the end panels 122 and the bottom panel 126 form a cavity 116 into which a food product 114, e.g., a sandwich, may be inserted. The cavity 116 formed by the side panels 120, the end panels 122 and the bottom panel 126 may be covered by a plurality of top panels 130, 132, 134 that are each connected to edges of the side panels 120 and the end panels 122. Each of the side panels 120 and each of the end panels 122 is connected to the bottom panel 126 at their respective bottom edges. Each of the side panels 120 is connected to each of the end panels 122 at their respective side edges by a pair of corner panels 124. The top panel 130 is connected to one of the side panels 120 at a top edge. The top panels 132 are connected to each of the end panels 122 at their respective top edges. The top panel 134 is connected to another of the side panels 120 at a top edge.

As is shown in FIG. 1A, the food container 110 is shown in an assembled state. Each of the side panels 120 is connected to the bottom panel 126 and folded upwardly and inwardly with respect to the bottom panel 126. Additionally, each of the corner panels 124 (not shown in FIG. 1A) is further folded inwardly with respect to the side panels 120 and the end panels 122, e.g., into the cavity 116. Each of the top panels 132 is folded over at least a portion of the cavity 116 and over the corner panels 124 (not shown in FIG. 1A). The top panel 134 is folded over at least a portion of the cavity 116, and over portions of the top panels 132. The top panel 130 is folded over at least a portion of the cavity 116, and over portions of the top panel 134 and the top panels 132.

Additionally, as is shown in FIG. 1A, one of the side panels 120 includes a window 136 or other opening through which contents of the cavity 116, e.g., the food product 114, may be viewed from outside of the container 110. The window 136 is covered by a layer 140 of cellophane or other transparent or translucent material.

The container 110 is maintained in the assembled state shown in FIG. 1A by an adhesive band 142 and/or an adhesive seal 138 (not shown in FIG. 1A). For example, as is shown in FIG. 1A, the adhesive band 142 extends over and across the container 110, from one side panel 120 to another side panel 120, and maintains the top panels 130, 132, 134 folded and closed in place over the cavity 116. The adhesive band 142 includes a bar code 144 or other machine readable (or optically readable) marking, a name 146 or descriptor of the container 110 or the food product 114 therein, and a price 148 of the food product 114. Alternatively, the container 110 may be maintained in the assembled state shown in FIG. 1A by any other device or substance, including one or more rubber bands (or elastic bands) or other tapes or labels with or without markings thereon (e.g., masking tape).

Those of ordinary skill in the pertinent arts will recognize that any number of the adhesive bands 142 or other layers may be provided on the container 110, and in any orientation, e.g., in a transverse manner from one side panel 120 to another side panel 120, such as is shown in FIG. 1A, in a longitudinal manner from one end panel 122 to another end panel 122, or in any other manner, in view of the present disclosure. Similarly, those of ordinary skill in the pertinent arts will recognize that any type of information may be provided on one or more of the adhesive bands 142, including the bar code 144, the name 146, the price 148 or any other relevant information (e.g., ingredients of the food product 114, sell-by dates for the food product 114, locations of origin of the food product 114).

Figure 1B:
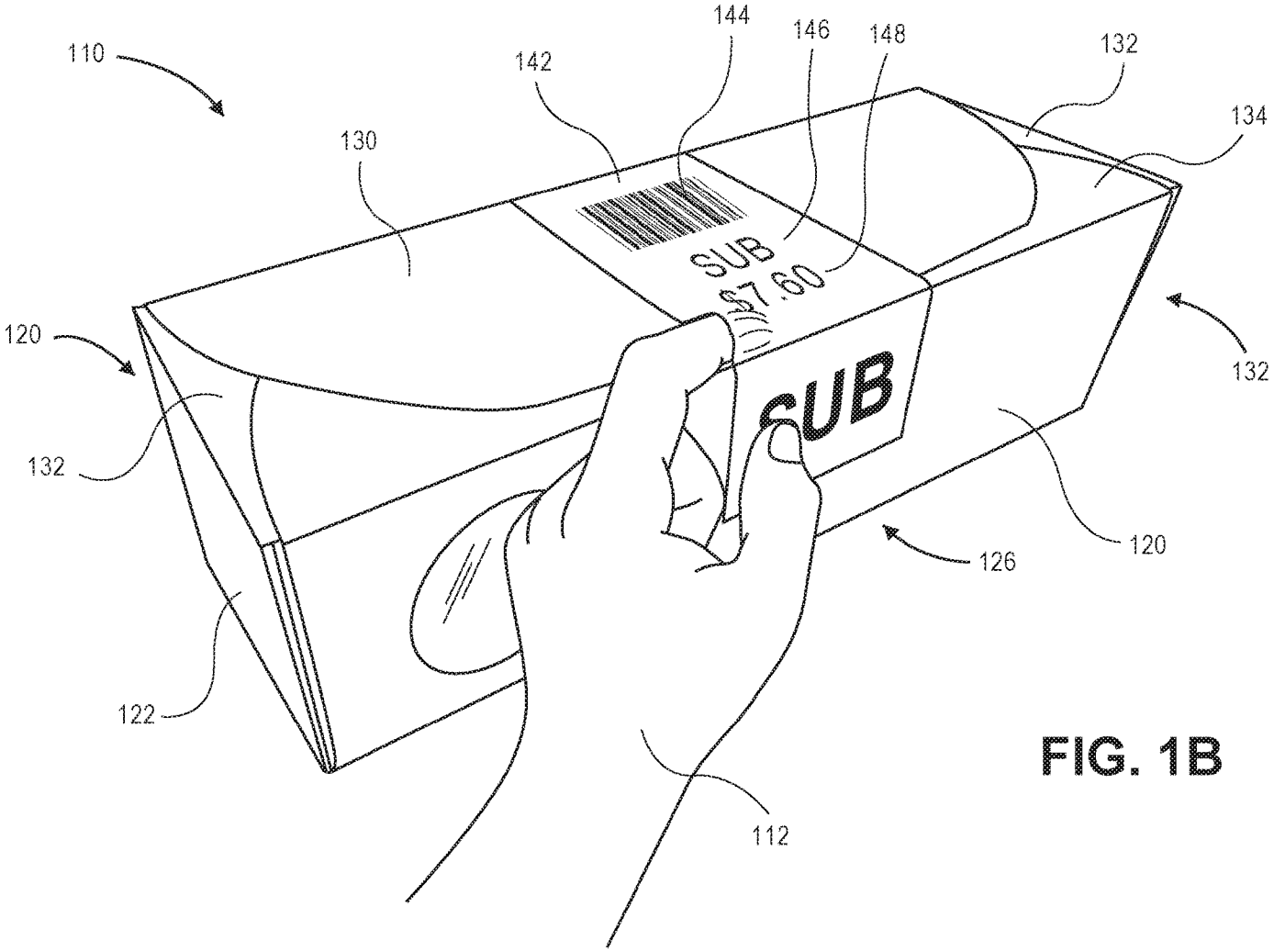
Figure 1C:
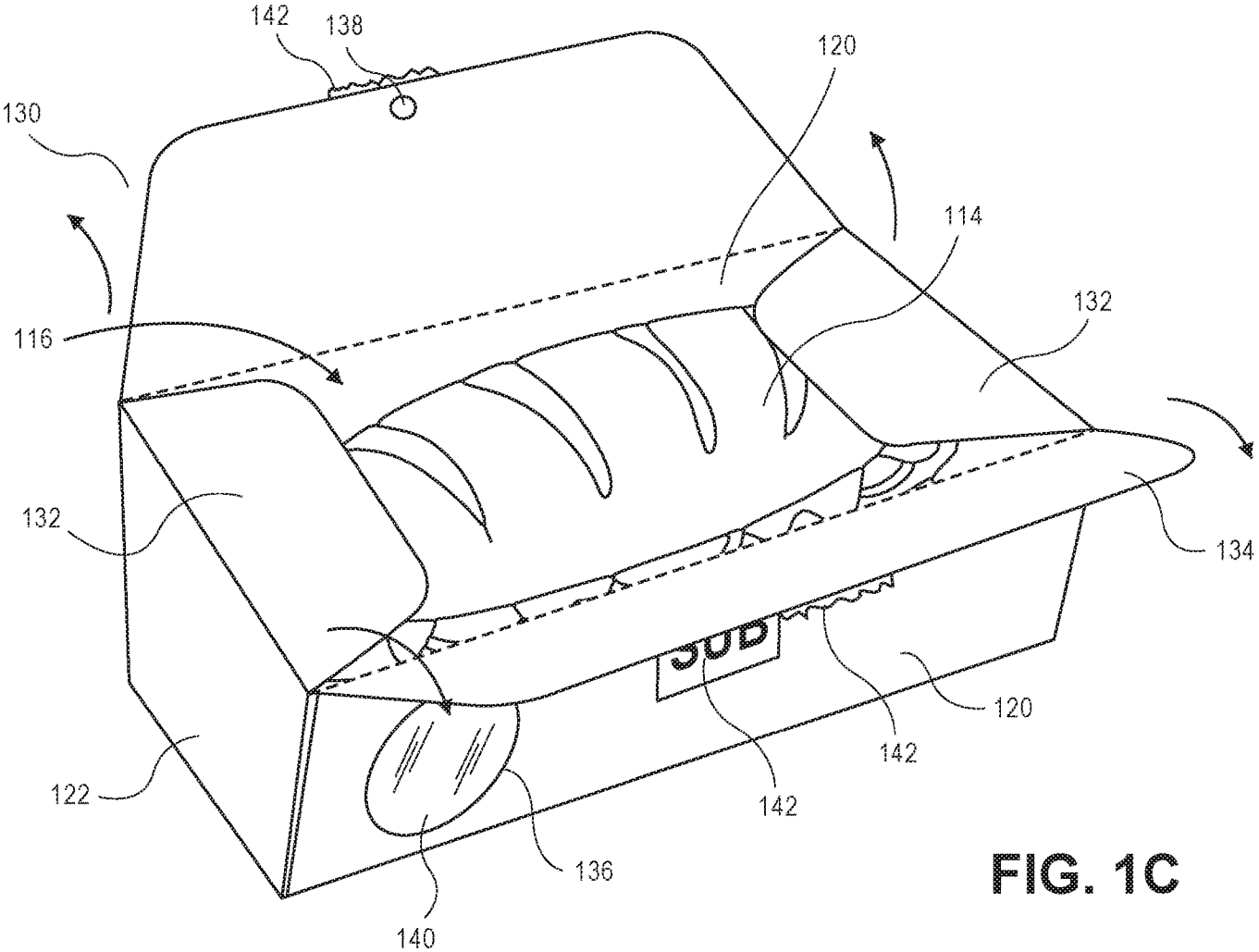

As is shown in FIG. 1B, the container 110 may be opened by a customer 112, who must first tear the adhesive band 142, or separate the adhesive band 142 from one or more of the top panels 130, 132, 134, using a pointer finger or other digit, a knife or other tool, or any other object. As is shown in FIG. 1C, the cavity 116 and the food product 114 therein may be exposed by folding open the top panel 130 and the top panel 134. The adhesive seal 138 may be any form of tape, paste, glue or other substance that may, as is shown in FIG. 1C, be applied to a lower side or face of the top panel 130, such that the adhesive seal 138 releasably bonds with an upper side or face of the top panel 134 when the top panel 134 is folded over the cavity 116 and when the top panel 130 is folded over the top panel 134, e.g., in the configuration shown in FIG. 1B.

Figure 1D:
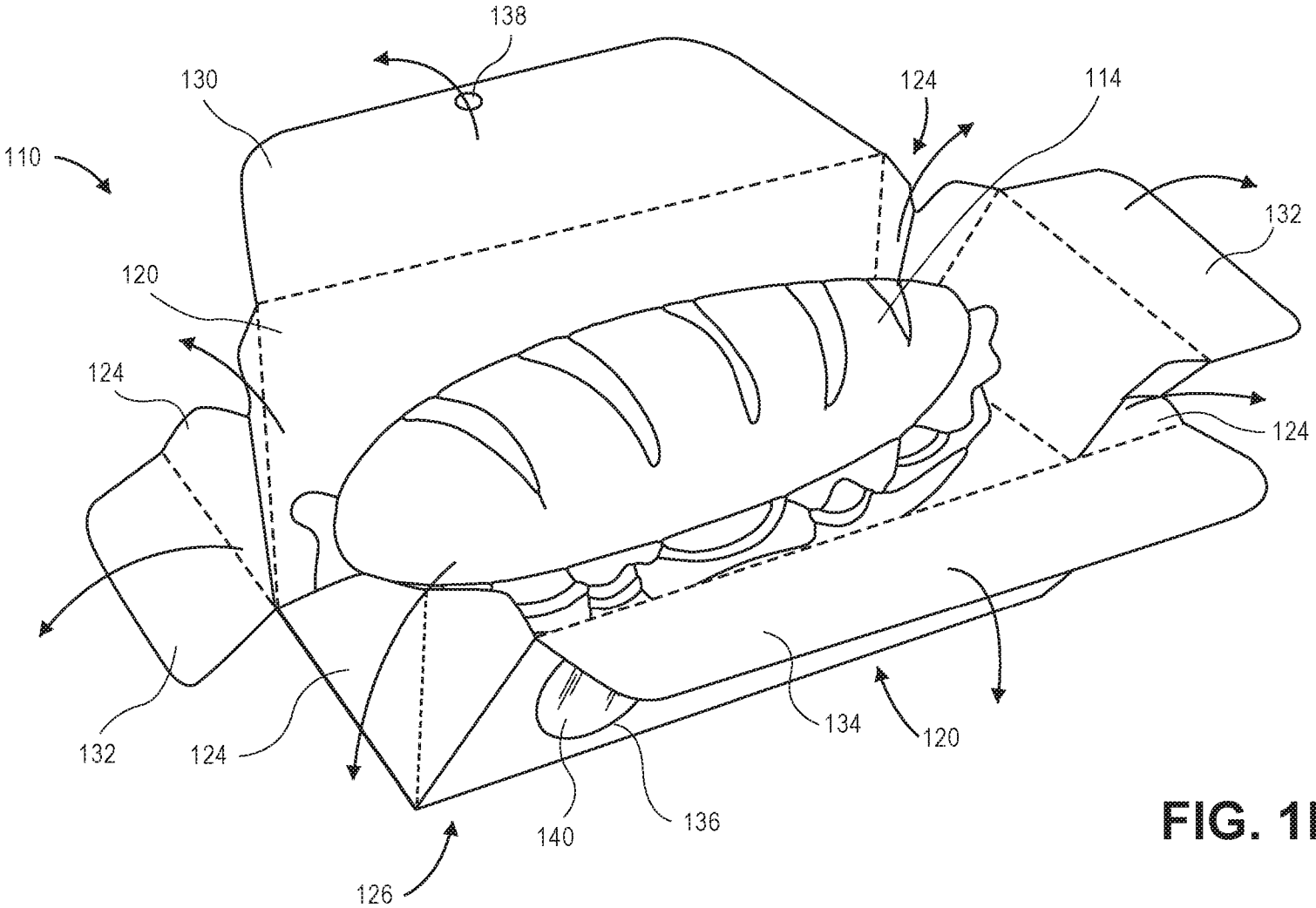

As is shown in FIG. 1D, after each of the top panels 132 is opened and unfolded from above the cavity 116, the container 110 begins to collapse from the assembled state of FIGS. 1A through 1C. In particular, once the top panels 132 are lifted from above the corner panels 124, which were folded into the cavity 116 in the assembled state shown in FIGS. 1A through 1C, the corner panels 124 begin to unfold and expand outwardly from the cavity 116, thereby also causing the side panels 120 and the end panels 122 to flatten, and exposing more of the food product 114.

Figure 1E:
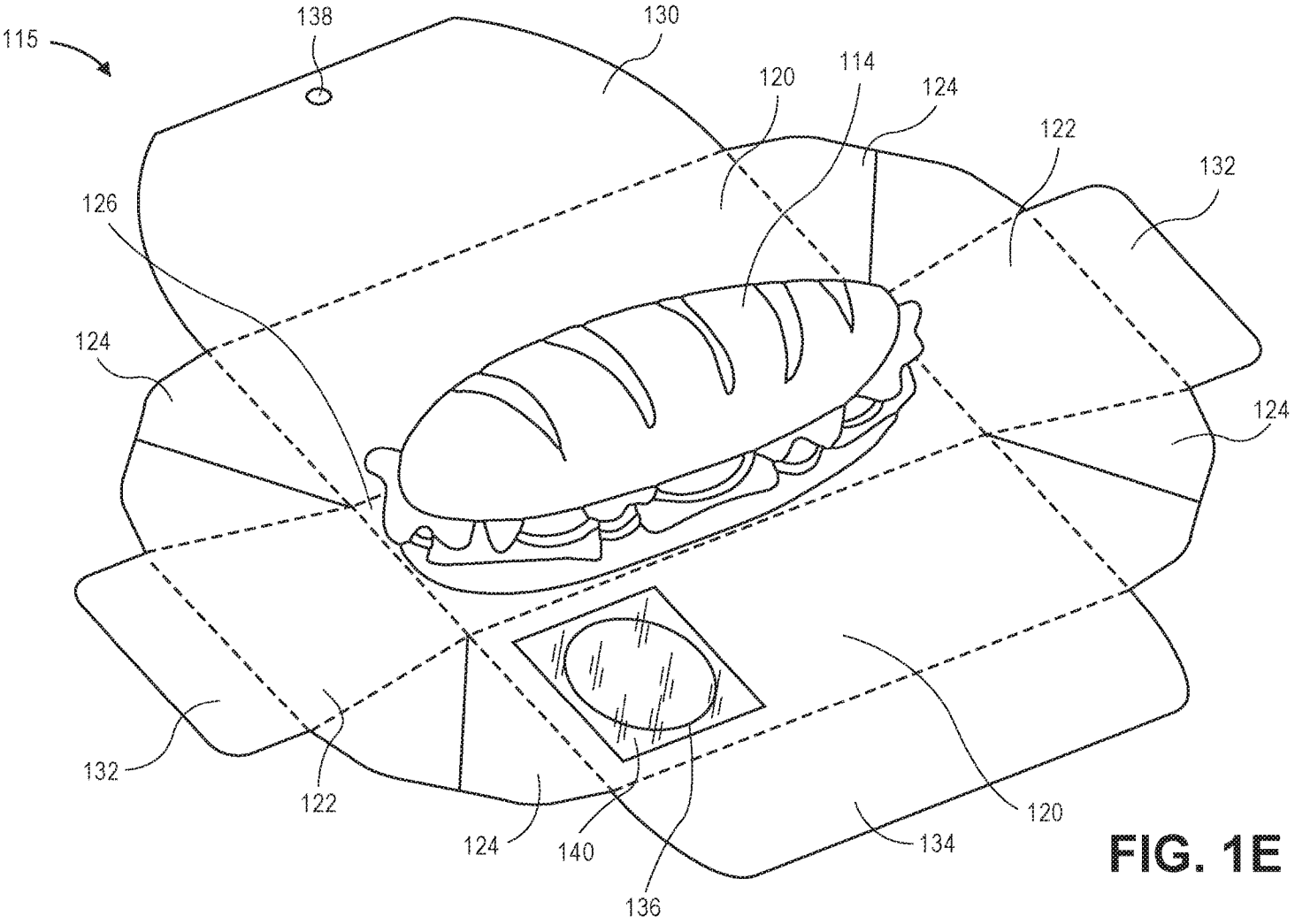

As is shown in FIG. 1E, each of the side panels 120, the end panels 122 and the corner panels 124 has been entirely unfolded and flattened into the blank 115. The side panels 120, the end panels 122, the corner panels 124 and the bottom panel 126 of the blank 115 form a substantially oval shape with the food product 114 disposed in a substantially central portion thereof, and the customer 112 may consume some or all of the food product 114 using the blank 115 as a plate.

Additionally, after the customer 112 has finished eating some, but not all, of the food product 114, the customer 112 may fold the blank 115 into the container 110 again, and enclose any remaining portions of the food product 114 within the cavity 116. For example, the customer 112 may fold the corner panels 124, the side panels 120 and the end panels 122 toward the food product 114, e.g., upwardly and inwardly, to reform the cavity 116. Once the cavity 116 has been reformed, the customer 112 may then fold the top panels 132 over the cavity 116 and the folded corner panels 124, such as is shown in FIG. 1C. The customer 112 may then fold the top panel 134 over the cavity 116 and the top panels 132, and then fold the top panel 130 over the top panel 134, sealing the top panel 130 into place atop the top panel 134 by the adhesive seal 138. Processes of folding the blank 115 into the container 110 to enclose the food product 114 therein, and unfolding the container into the blank 115 to allow the food product 114 to be consumed, may be repeated as many times as desired.

Accordingly, the systems and methods of the present disclosure are directed to food containers that may be readily converted between an assembled state (or a folded state) and a flat state (or unfolded state). In the assembled state, the containers of the present disclosure may enclose one or more food products therein. In the flat state, the containers of the present disclosure may serve as a plate, and enable one or more users to consume the food products thereon. In some implementations, the containers may be formed from a single blank of paperboard, cardboard or like materials that may be easily manipulated by hand to convert the containers between the assembled state and the flat state. In some implementations, the containers may be held in the assembled state by one or more adhesive labels, seals or other devices or substances that may be applied to one or more external surfaces of the containers, or between two or more panels of the blank from which the containers are formed. The adhesive labels of the present disclosure may be formed from any materials upon which information or data (e.g., one-dimensional or two-dimensional bar codes or fiducial markings, alphanumeric characters, or other symbols) may be embedded, engraved, etched, inscribed, printed or written. The adhesive seals of the present disclosure are preferably two-sided adhesive tapes, layers or other substances, such as glues or pastes, that may releasably adhere to two or more top panels or layers to enclose food products within containers.

Any number of adhesive layers or adhesive seals may be applied to the blanks or the containers of the present disclosure. Additionally, any number of other features or means for enclosing a container may be utilized in accordance with the present disclosure, including but not limited to hook and loop fasteners applied to two or more of the top panels, corresponding mechanical clips or notches cut into two or more of the top panels, or the like. The containers may also be held in assembled states by rubber bands, elastic bands or any other tapes or labels, such as masking tape, in accordance with the present disclosure.

The blanks of the present disclosure may be formed from any suitable materials that may be folded into containers (e.g., in assembled states) or unfolded (e.g., into flat states), and provide structural support for masses and volumes of food products in either state. For example, one or more panels of the blanks may be formed from any cellulose-based or non-cellulose based materials including but not limited to foldable materials such as cardboards (e.g., card stock, corrugated fiberboard or paperboards such as white board, solid board, chipboard or fiberboard), or any similarly workable and durable materials of any size or thickness. In some implementations, the blanks may be formed from eighteen-point craft paperboard. The paperboard may be oil and grease resistant (or "OGR"), and may be coated on one or more sides or faces, e.g., with one or more grease resistant liquids or other substances that render the resistant to oils, greases or like substances (including but not limited to canola oil, corn oil, olive oil, palm oil, peanut oil, soybean oil, and other vegetable oils, or other oils or greases such as butter, lard, margarine, as well as condiments such as ketchup, mustard or salad dressing) that are commonly utilized in the preparation of foods or applied to the foods prior to their consumption.

Additionally, where a container is formed into an assembled state from a blank in accordance with the present disclosure, such as the container 110 and blank 115 of FIGS. 1A through 1E, substantially flat surfaces of the container may provide one or more advantages over containers of the prior art. Typically, applying flat labels to food products that are substantially round, cylindrical or tubular in shape, such as sandwiches, burritos, crullers or other similarly shaped foods, or stacking two or more of such food products atop one another, is geometrically challenging. Flat labels do not readily apply to curved or non-flat surfaces, and food products such as sandwiches, burritos or crullers are both unstable and prone to roll. Referring again to the container 110 of FIG. 1A, the substantially flat surface atop the container 110, formed by the top panels 130, 132, 134, ensures that the adhesive label 142 and the bar code 144, the name 146, the price 148 or one or more other machine readable markings or optically readable markings thereon will remain flat, and are more easily read and interpreted by humans or scanning machines (e.g., scanners, readers or imaging devices). Similarly, the substantially flat surface atop the container 110 enables other objects to be stacked or rested atop the container 110, including but not limited to one or more other convertible food containers having the same type, size, form or shape as the container 110.

The containers of the present disclosure may also take any shape or form. For example, referring again to the container 110 and the blank 115 of FIGS. 1A through 1E, blanks may be formed into containers having cavities with rectangular or trapezoidal cross sections and/or rectangular or trapezoidal volumes, or with cross sections or volumes of any other polygonal shapes (e.g., triangles, pentagons, hexagons, octagons or the like). Moreover, the edges about which such blanks are folded or otherwise formed into such containers may be straight, such as is shown in the container 110 and the blank 115 of FIGS. 1A through 1E, or may be formed from two or more lines or line segments provided at different angles with respect to one another. Accordingly, the blanks of the present disclosure may likewise take any corresponding shape or form, and may be formed from bottom panels, side panels, end panels, corner panels or top panels of any relevant size.

One or more panels of the blanks or containers of the present disclosure may include windows or other openings that permit a customer to visibly evaluate contents of enclosed containers. For example, referring again to FIGS. 1A through 1E, the window 136 is a circular opening cut into one of the side panels 120. The windows or other openings may be of any size and take any shape or form, and may be cut or formed into any panels, and need not be limited to circular openings that are cut into side panels. Additionally, such panels may be optionally covered or sealed with one or more layers of transparent or translucent materials, e.g., cellophane or like materials, that may be applied to either side or face (or both sides or faces) of a blank, e.g., by glue or other adhesives, and may thus appear on internal or external surfaces of a container formed from the blank.

In some implementations, the various panels of a blank may be pre-formed with scores and/or scored lines in specific locations on the blank where folding must occur in order to convert the blank (e.g., in a flat state) to a container (e.g., in an assembled state). For example, referring again to the blank 115 of FIG. 1E, one or more of the lines or boundaries between the respective panels (e.g., between the side panels 120 and the corner panels 124, or between the corner panels 124 and the side panels 120 or the end panels 122, may be pre-scored prior to or after cutting the blank 115 from a larger sheet of material, e.g., by pressing, folding, cutting or otherwise modifying the surfaces of the blank 115 at such locations. Such scores may include, but are not limited to, any impressions, creases or other modifications imposed on either side or face of a blank or an individual panel for the purpose of positioning and/or facilitating folds within the band. For example, some scores may include, but are not limited to, cuts, creases, grooves, perforations, ridges or any other features for aiding in folding of blanks or panels in specific locations. In some implementations, such locations may be pre-scored with a cut of approximately one-half of a thickness of the blank 115 (e.g., a cut of approximately a nine-point depth into an eighteen-point thick piece of paperboard or cardboard), thereby facilitating the folding of the blank 115 in such locations. In some implementations, cuts of one-quarter or other fractions of a thickness of the blank 115 may be made in various locations, as necessary.

Furthermore, because scoring or creasing the blank 115 creates a recess or indentation on one side or face of the blank 115, and a bump or a raise on the other side or face of the blank 115, the blank 115 may be independently scored in different locations on either side or face of the blank 115, depending on a desired direction or magnitude of a fold that is required to place the blank 115 in the flat state, or to fold the blank 115 into the container 110, e.g., in the assembled state. For example, on a front face of the blank 115, locations where the side panels 120 and the end panels 122 are expected to fold upwardly and inwardly toward a center of the blank 115, e.g., to form the cavity 116, such locations may be pre-scored with a cut of approximately one-quarter to one-half of the thickness of the blank 115. Conversely, on a rear face of the blank 115, locations where the corner panels 124 are expected to bisect as the corner panels 124 are folded toward the center of the blank 115, e.g., into the cavity 116, such locations may be pre-scored with a cut of approximately quarter to one-half of the thickness of the blank 115. Pre-scoring the blank 115 in this manner thus facilitates the processes by which the blank 115 is folded into the container 110, e.g., into the assembled state, and also naturally urges the container 110 to unfold itself into the flat state, e.g., after each of the top panels 130, 132, 134 has been unfolded and opened, such as is shown in FIG. 1C. Although the corner panels 124 are shown as having been scored by single bisecting lines, e.g., scored lines which physically or virtually divide such corner panels 124 into two portions of substantially equal areas, a corner panel may be scored with any number of scores that and/or otherwise partitioned into any number of portions having equal or unequal areas.

Referring to FIGS. 2A through 2G, views of one implementation of a convertible food container 210 in accordance with the present disclosure are shown. Except where otherwise noted, reference numerals preceded by the number "2" shown in FIGS. 2A through 2G indicate components or features that are similar to components or features having reference numerals preceded by the number "1" shown in FIGS. 1A through 1E.

Figure 2A:
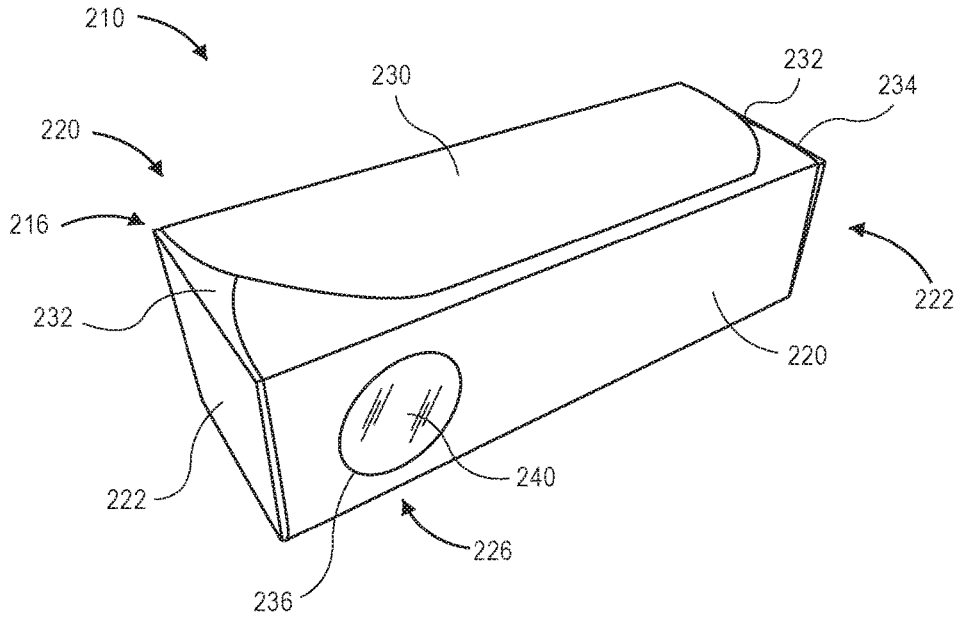
FIGS. 2A through 2G are views of one implementation of a convertible food container in accordance with the present disclosure.

FIG. 2A is a perspective view of the container 210. As is shown in FIG. 2A, the container 210 includes a pair of side panels 220, a pair of end panels 222 and a bottom panel 226 defining an internal cavity 216. The container 210 further includes four corner panels (not shown), similar to the corner panels 124 of FIGS. 1A through 1E, extending between each of the side panels 220 and each of the end panels 222. As is also shown in FIG. 2A, the cavity 216 is covered by a plurality of top panels 230, 232, 234 that are each connected to edges of the side panels 220 and the end panels 222, and are folded over the cavity 216 to enclose any food product (not shown) therein. In particular, the top panels 232 are folded over the cavity 216 first, followed by the top panel 234 that is connected to one of the side panels 220, and the top panel 230 that is connected to another of the side panels 220. Additionally, the one of the side panels 220 that is connected to the top panel 234 further includes a window 236 or other opening through which an interior of the cavity 216 may be viewed. The window 236 is covered by a sheet 240 of transparent or translucent material sealed to an internal surface of the side panel 220 (not shown), e.g., by glue or other adhesives.

Figure 2B:
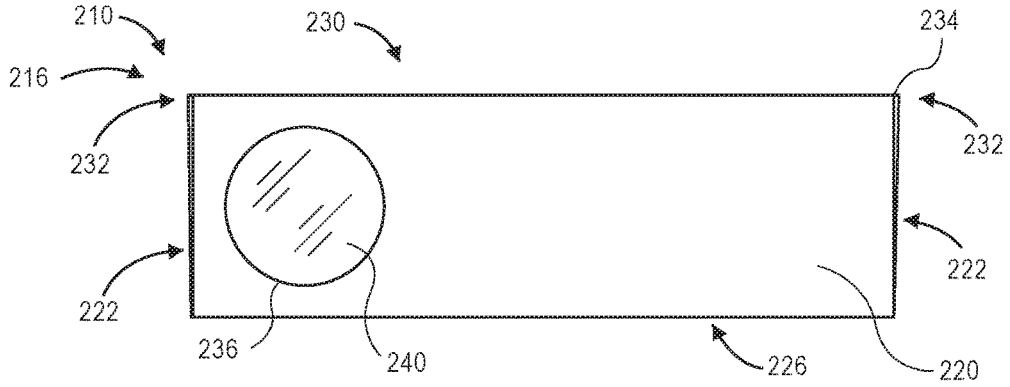
Figure 2C:
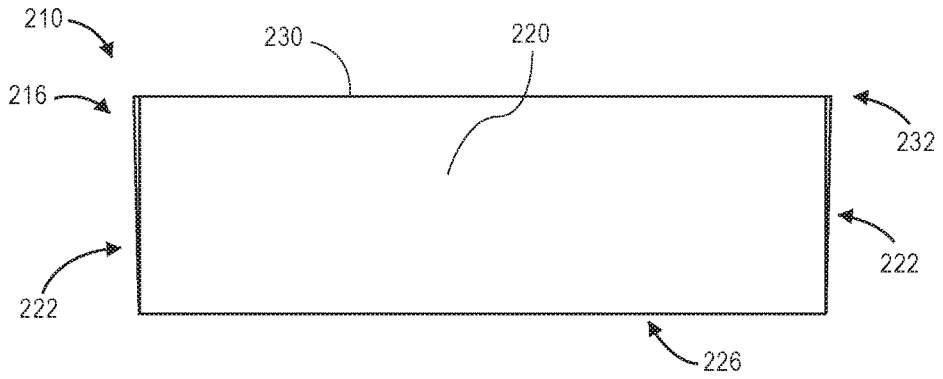
Figure 2D:
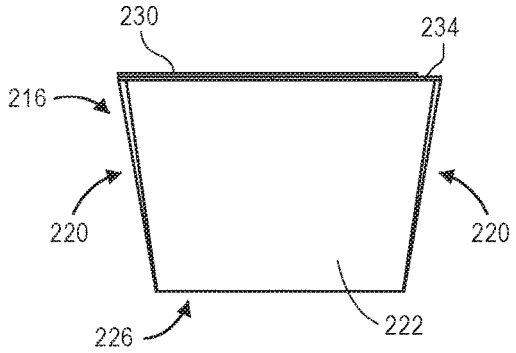
Figure 2E:
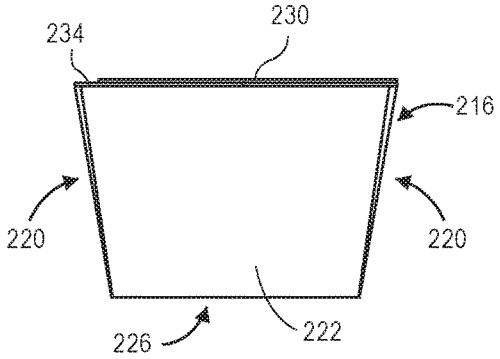

FIG. 2B and FIG. 2C are side views (e.g., left side and right side views) of the container 210. FIG. 2D and FIG. 2E are end views (e.g., front end and rear end views) of the container 210. As is shown in FIG. 2B and FIG. 2C, each of the side panels 220 is of a substantially rectangular shape is shown in FIG. 2D and FIG. 2E, each of the end panels 222 is of a substantially trapezoidal shape. Thus, because the shapes of the end panels 222 of the container 210 increase in area with respect to a distance from the bottom panel 226, a volume of the cavity 216 and a cross-sectional area of the cavity 216 increase in size with respect to the distance from the bottom panel 226.

Figure 2F:
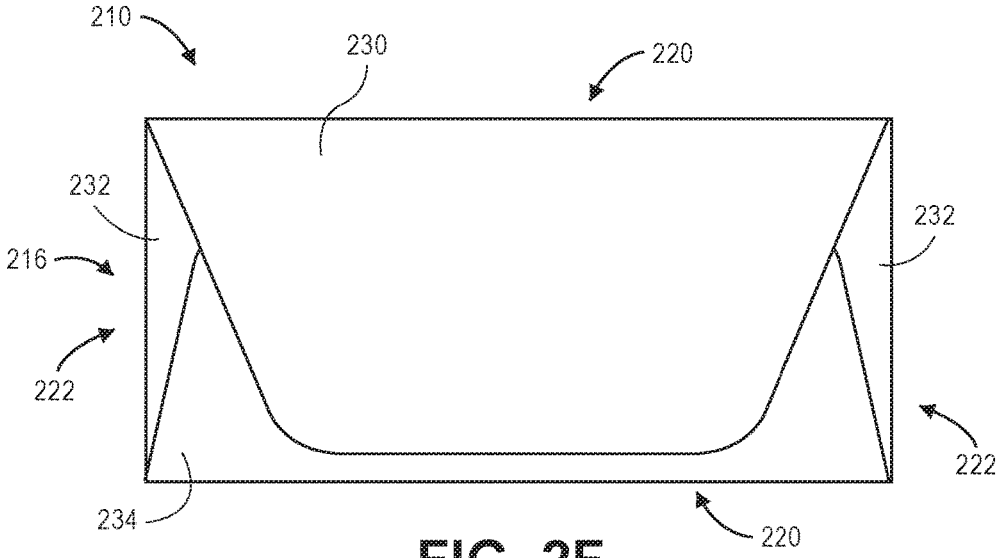
Figure 2G:
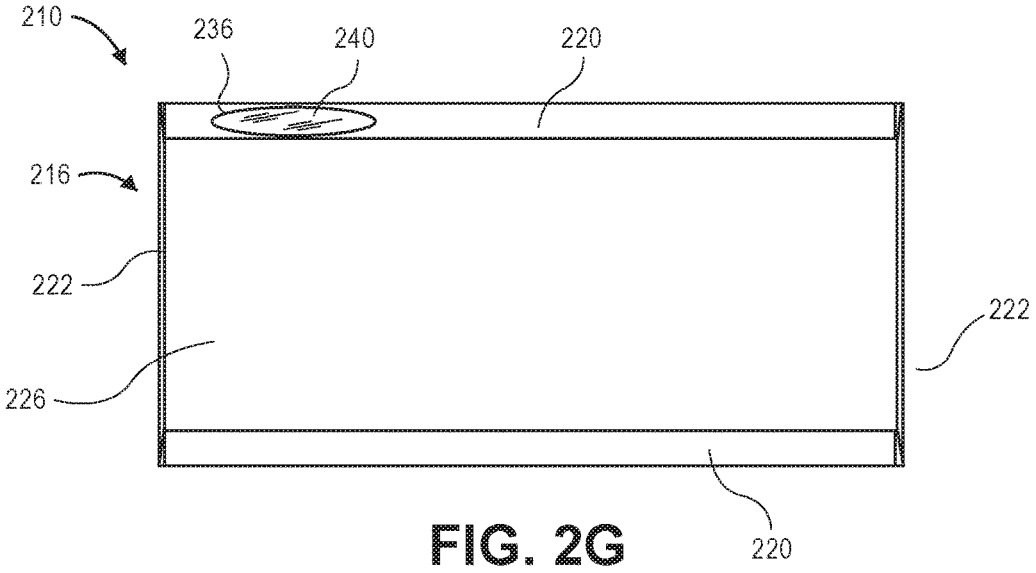

FIG. 2F and FIG. 2G are a top view and a bottom view, respectively, of the container 210. As is shown in FIG. 2F, the top panels 232 are folded downwardly from each of the respective end panels 222. The top panel 234 is then folded downwardly and atop each of the top panels, and the top panel 230 is folded downwardly and atop the top panels 232 and the top panel 234. The top panel 230 may be held in place above the top panel 234 and the top panels 232 by joining the top panel 230 with the top panel 234 and/or the top panels 232 by one or more adhesive seals (not shown), similar to the adhesive seal 138 of FIGS. 1C through 1E, thereby ensuring that the container 210 remains in the assembled state shown in FIGS. 2A through 2G. Alternatively, the top panel 230 may be held in place above the top panel 234 and the top panels 232 by a rubber band, an elastic band, a piece of masking tape or any other joining element (not shown).

Referring to FIGS. 3A through 3G, views of one implementation of a blank 315 from which a convertible food container may be formed in accordance with the present disclosure are shown. Except where otherwise noted, reference numerals preceded by the number "3" shown in FIGS. 3A through 3G indicate components or features that are similar to components or features having reference numerals preceded by the number "2" shown in FIGS. 2A through 2G or by the number "1" shown in FIGS. 1A through 1E.

Figure 3A:
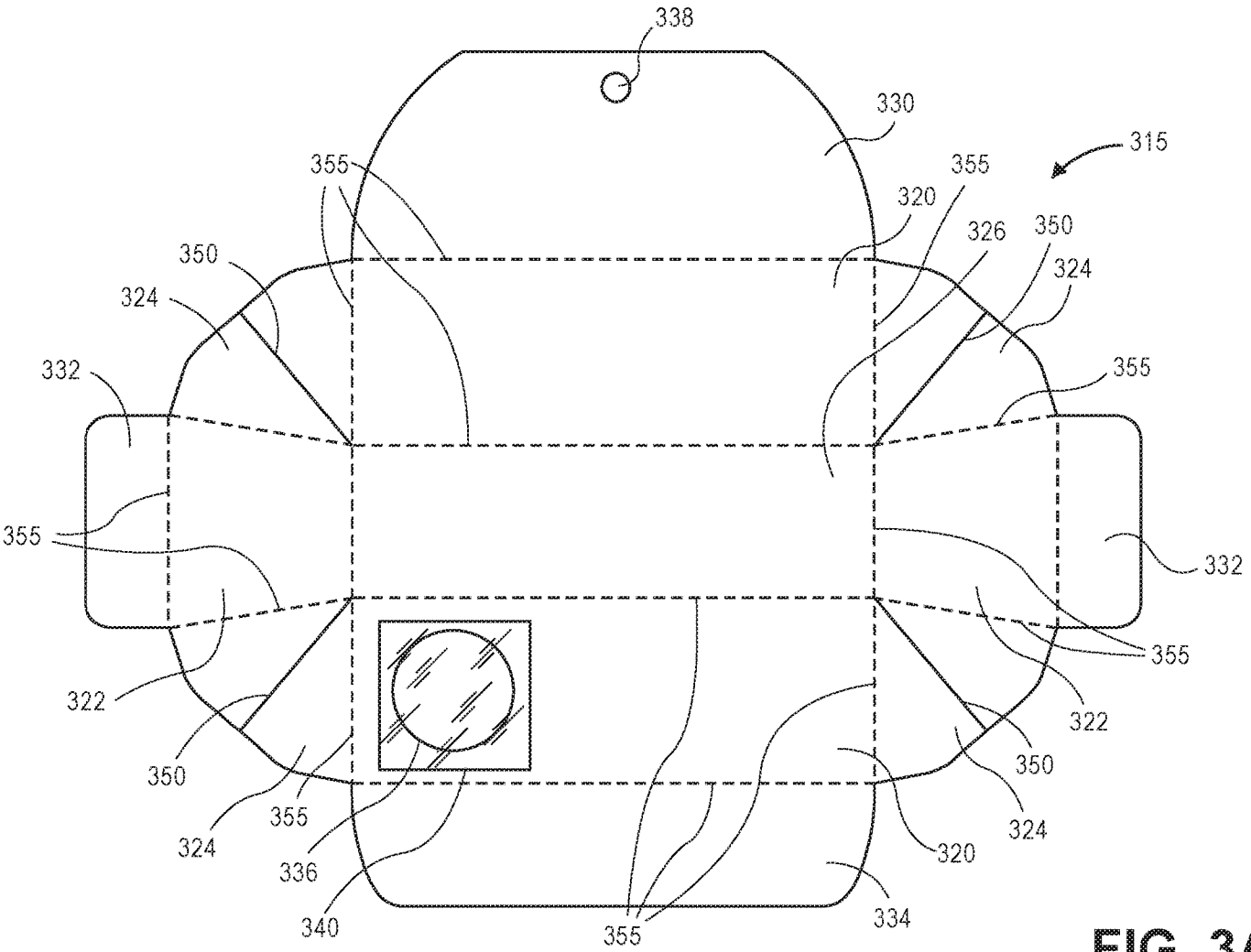
FIGS. 3A through 3G are views of one implementation of a blank from which a convertible food container may be formed in accordance with the present disclosure.
Figure 3B:
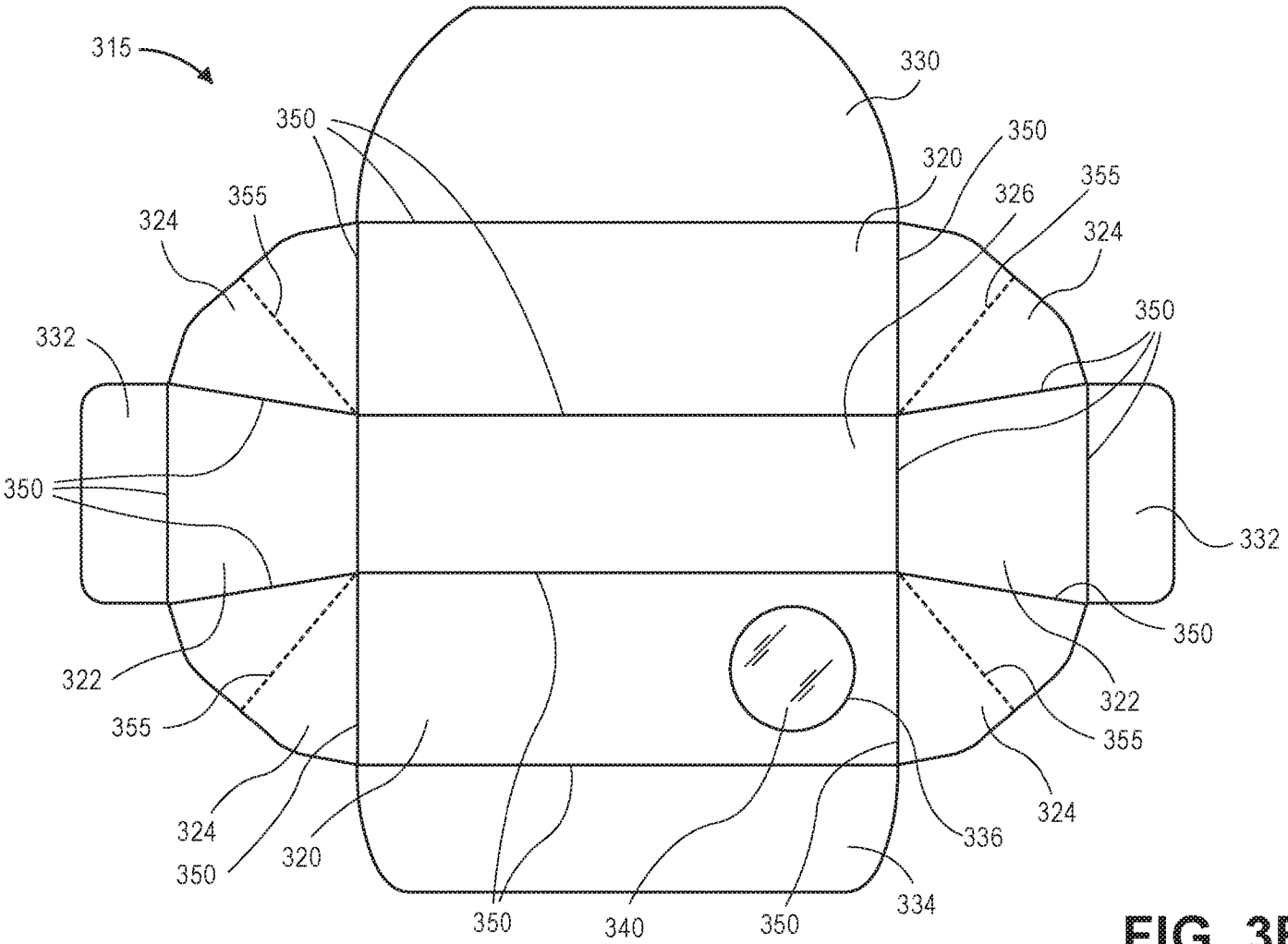

FIG. 3A and FIG. 3B are a top view and a bottom view, respectively, of the blank 315. As is shown in FIG. 3A and FIG. 3B, the blank 315 includes a pair of side panels 320, a pair of end panels 322 and a bottom panel 326. The side panels 320 and the end panels 330 are connected about edges of the bottom panel 326. The blank 315 further includes four corner panels 324 that are connected to and extend between edges of each of the side panels 320 and each of the end panels 322. As is also shown in FIG. 3A and FIG. 3B, a top panel 330 is connected to an edge of one of the side panels 320, and a top panel 334 is connected to an edge of another of the side panels 320, while top panels 332 are connected to edges of each of the end panels 320.

The one of the side panels 320 that is connected to the top panel 334 further includes a window 336 or other opening through which an interior of the cavity 316 may be viewed. As is shown in the top view of FIG. 3A, the window 336 is covered by a sheet 340 of transparent or translucent material sealed to an internal surface of the side panel 320, e.g., by glue or other adhesives.

Additionally, as is also shown in FIG. 3A, an adhesive seal 338 is provided on one surface of the top panel 330. In accordance with the present disclosure, the blank 315 may be formed into an assembled state, e.g., into a container such as the container 210 of FIGS. 2A through 2G, by folding the side panels 320, the end panels 322, and centers of the corner panels 324 upwardly and inwardly with respect to the top view of FIG. 3A, and outwardly with respect to the bottom view of FIG. 3B, toward a center of the bottom panel 326, thereby forming a cavity into which one or more food products may be placed. Such food products may be enclosed within the container first by folding the end panels 322 upwardly and inwardly with respect to the top view of FIG. 3A, and outwardly with respect to the bottom view of FIG. 3B, then by folding the end panel 324 upwardly and inwardly with respect to the top view of FIG. 3A, and outwardly with respect to the bottom view of FIG. 3B, and finally by folding the end panel 324 upwardly and inwardly with respect to the top view of FIG. 3A, and outwardly with respect to the bottom view of FIG. 3B, toward a center of the bottom panel 326. The container may be enclosed with food products therein by joining the adhesive seal 338 applied to the top panel 330 shown in FIG. 3A with a corresponding surface of the top panel 334 shown in FIG. 3B.

The sides or faces of the blank 315 shown in FIG. 3A and FIG. 3B are scored with lines in specific locations where folds are to be made when assembling the blank 315 into a container. For example, such scores or scored lines may include any modifications imposed on either side or face of the blank 315 or any panels thereof, e.g., cuts, creases, grooves, perforations, ridges or any other features for aiding in folding of blanks or panels in such locations. As is shown in the top view of the blank 315 of FIG. 3A, each of the corner panels 324 includes a scored line 350 that substantially bisects the corner panel 324. Thus, when the blank 315 is to be folded into a container in an assembled state, the scored lines 350 will facilitate the drawing inward of the corner panels 324 in a manner that also brings the edges of the respective side panels 320 and the respective end panels 322 inward, as well. As is also shown in the top view of the blank 315 shown in FIG. 3A, locations at which the side panels 320, the end panels 322, the corner panels 324, the bottom panel 326 and the top panels 328 are connected to one another are shown with unscored lines 355.

Conversely, as is shown in the bottom view of the blank 315 shown in FIG. 3B, locations within the corner panels 324 which correspond to the scored lines 350 of FIG. 3A are shown with unscored lines 355. Likewise, locations at which the side panels 320, the end panels 322, the corner panels 324, the bottom panel 326 and the top panels 328 are connected to one another are marked by scored lines 350 in locations corresponding to the unscored lines 355 shown in FIG. 3A. In accordance with the present disclosure, the scored lines 350 shown in FIG. 3A and FIG. 3B may be independently pressed, folded, cut or otherwise modified into the respective sides or faces of the blank, e.g., at fractions of the thickness of the blank 315, such as one-quarter or one-half of the thickness, or any other fraction. The forming of the scored lines 350 shown in FIG. 3A and FIG. 3B may result in negative changes in elevation on such sides or faces of the blank 315, and the formation of corresponding bumps, raises or other positive changes in elevation at the unscored lines 355 on opposite sides or faces of the blank 315, as shown in FIGS. 3A and 3B. Scored lines and unscored lines of the present disclosure, including but not limited to the scored lines 350 or the unscored lines 355 of FIGS. 3A and 3B, may, but need not, visible to the human eye. Furthermore, scored lines and unscored lines may be straight (e.g., unbroken), such as is shown in FIGS. 3A and 3B, or may have two or more segments that are provided at different angles.

Figure 3C:
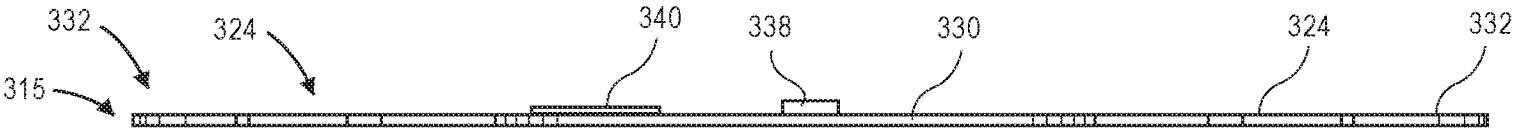
Figure 3D:
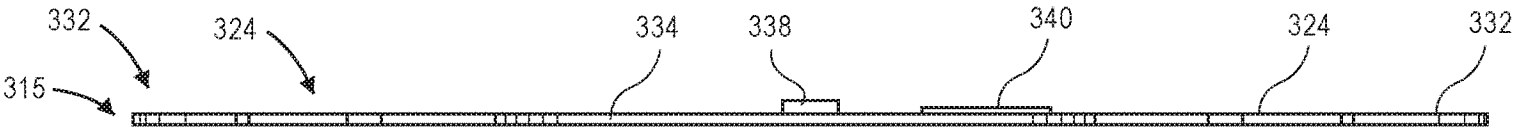
Figure 3E:
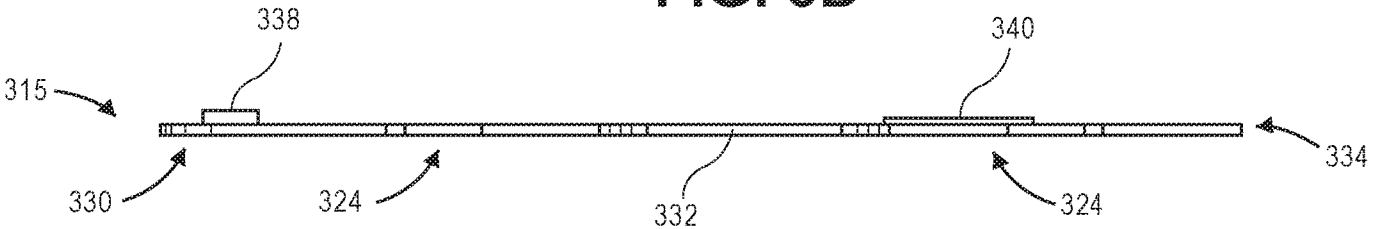
Figure 3F:
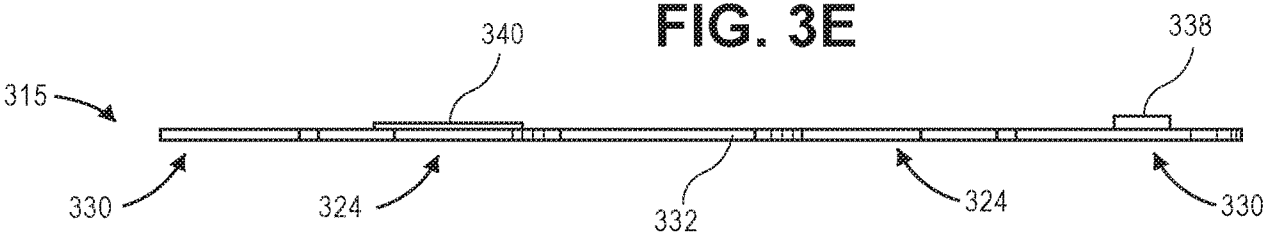
Figure 3G:
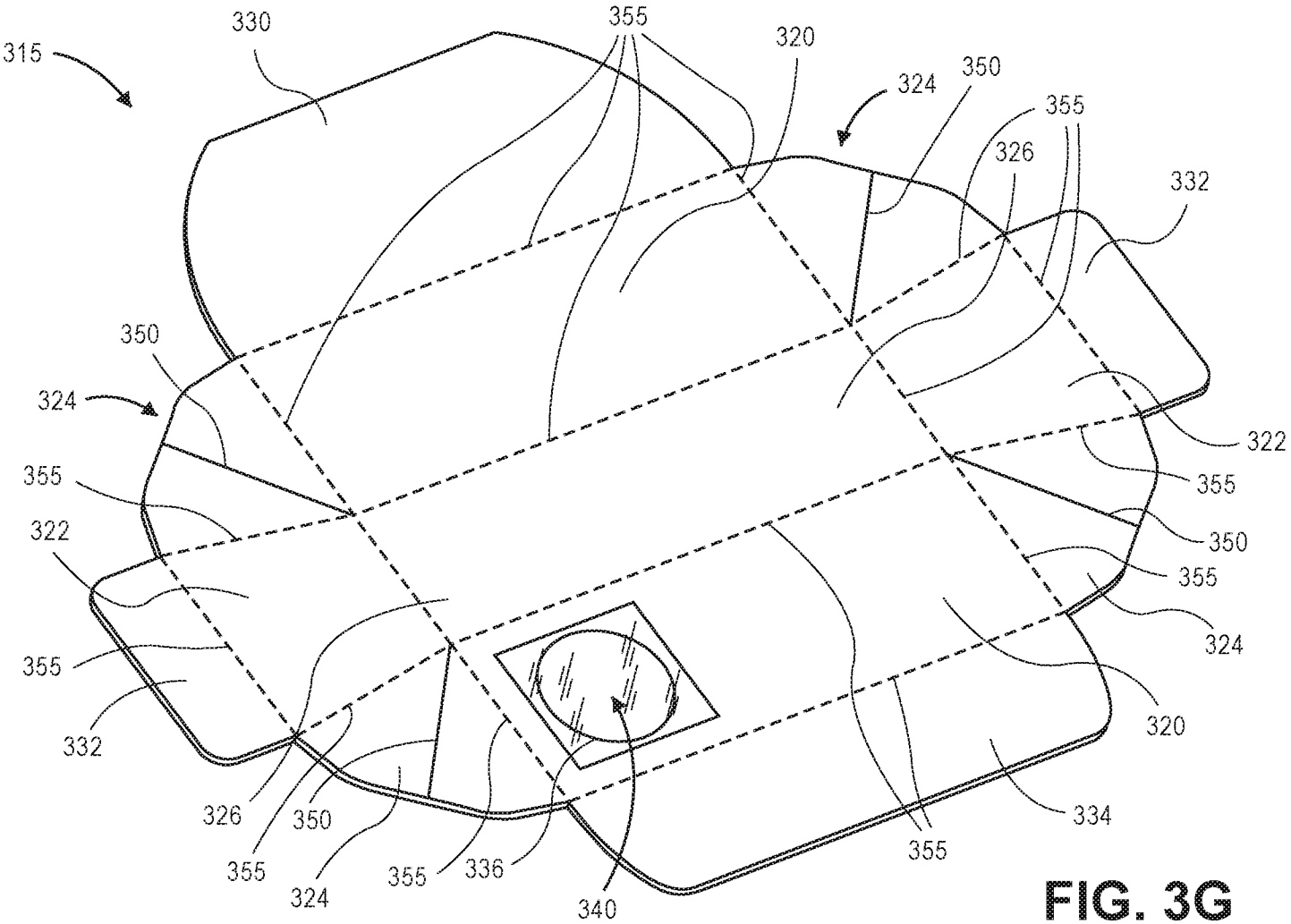

FIG. 3C and FIG. 3D are side views (e.g., left side and right side views) of the blank 315. FIG. 3E and FIG. 3F are end views (e.g., front end and rear end views) of the blank 315. FIG. 3G is a perspective view of the blank 315. As is noted above, in some implementations, the blank 315 may be formed from eighteen-point craft paperboard and/or made oil and grease resistant on one or both sides or faces. In other implementations, the blank 315 may be formed from any other cellulose-based or non-cellulose-based materials of any thickness. In still other implementations, the blank 315 may be formed from two or more different materials. For example, in some implementations, the side panels 320 and the end panels 322 of the blank may be formed from a rigid or semi-rigid material, such as paperboard, while the corner panels 324 of the blank may formed from flexible or elastic materials, such as one or more rubbers, or reinforced by one or more springs or spring-like features for urging the corner panels 324 upwardly and inwardly when the blank 315 is folded into a container, and downwardly and outwardly when the blank 315 is intended for use as a plate.

During the preparation or packaging of food products in blanks and containers of the present disclosure, a blank may be formed into a semi-folded condition by a frame or other fixture that may be modular in nature, with one or more corner assemblies that may be interchangeably installed into a mounting plate or like fixture as necessary in order to accommodate blanks and/or containers of any size or shape. The frames or fixtures may include tall fins or other extensions that may pre-fold portions of the blanks (e.g., corner panels, end panels or side panels) into the semi-folded condition, thereby enabling a food product to be deposited therein. In some implementations, a food product such as a sandwich, a cheeseburger or a hot dog may be prepared within the blank in the semi-folded condition, and subsequently folded into a container having an assembled state.

Referring to FIGS. 4A through 4E, views of one implementation of a system including a convertible food container and assembly frame in accordance with the present disclosure are shown. Except where otherwise noted, reference numerals preceded by the number "4" shown in FIGS. 4A through 4E indicate components or features that are similar to components or features having reference numerals preceded by the number "3" shown in FIGS. 3A through 3G, by the number "2" shown in FIGS. 2A through 2G or by the number "1" shown in FIGS. 1A through 1E.

Figure 4A:
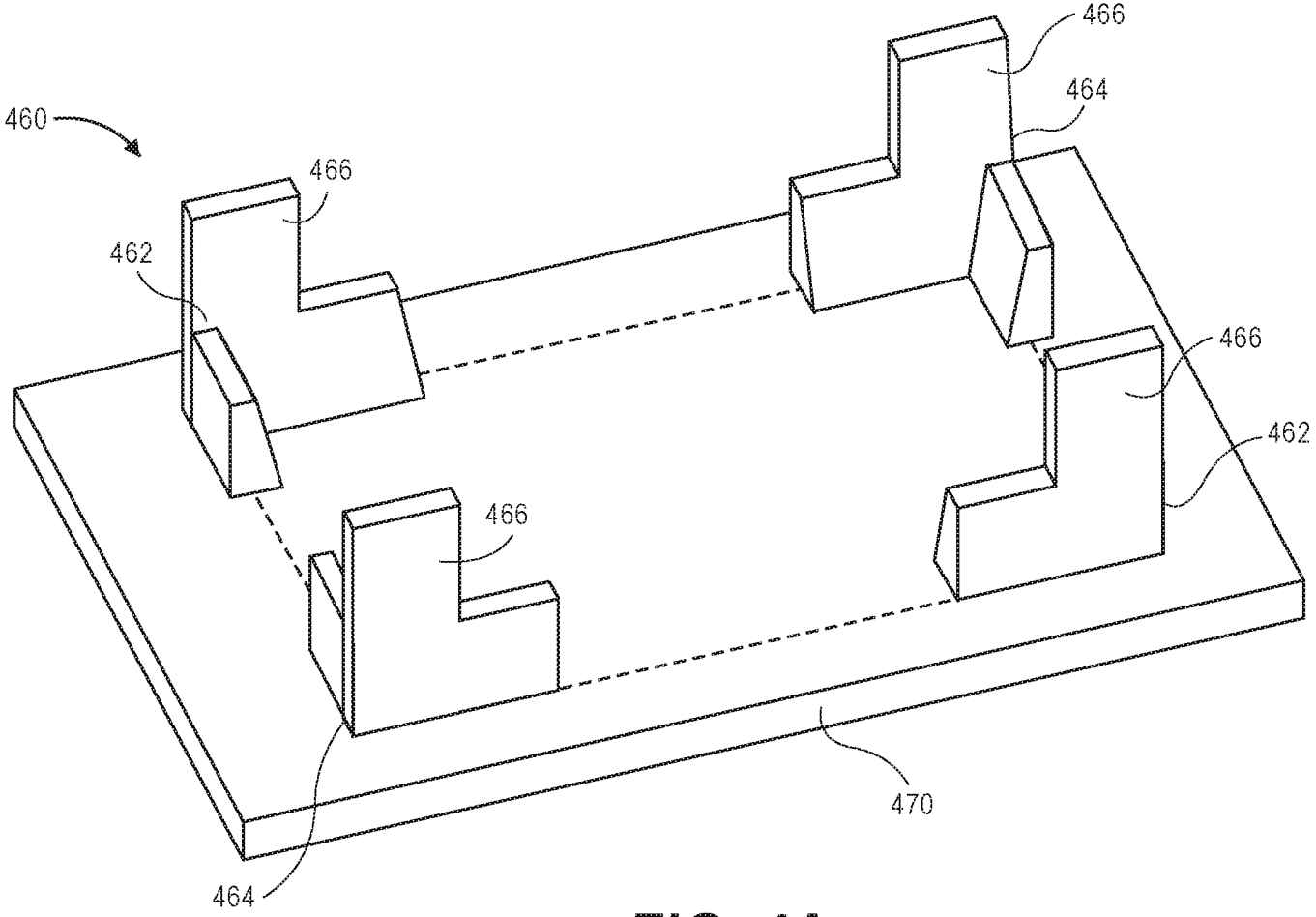
FIGS. 4A through 4E are views of one implementation of a system including a convertible food container and assembly frame in accordance with the present disclosure.

FIG. 4A is a perspective view of an assembly frame 460. The assembly frame 460 includes pairs of corner assemblies 462, 464, each having a vertical fin (or extension) 466, that are releasably installed in a mounting plate 470. The corner assemblies 462, 464 each include a comparatively long side and a comparatively short side, with the vertical fin 466 mounted to the comparatively long side at an intersection with the comparatively short side. Thus, as is shown in FIG. 4A, the corner assemblies 462, 464 that are diagonally opposed to one another across the mounting plate 470 are alike in construction and function. Alternatively, the sides of the corner assemblies 462, 464 may have any length, or the vertical fins 466 may be installed in corners of such assemblies or on either side. Where a corner assembly includes sides of equal length, and vertical fins installed at intersections of such sides, each of the corner assemblies may be alike and interchangeable with one another. Moreover, the mounting plate 470 may include any number of slots, holes or other openings (not shown) for interchangeably receiving pegs or extensions of the respective corner assemblies 462, 464 therein. Accordingly, the assembly frame 460 may be modified, as necessary, to accommodate blanks and/or containers of any size or shape.

Figure 4B:
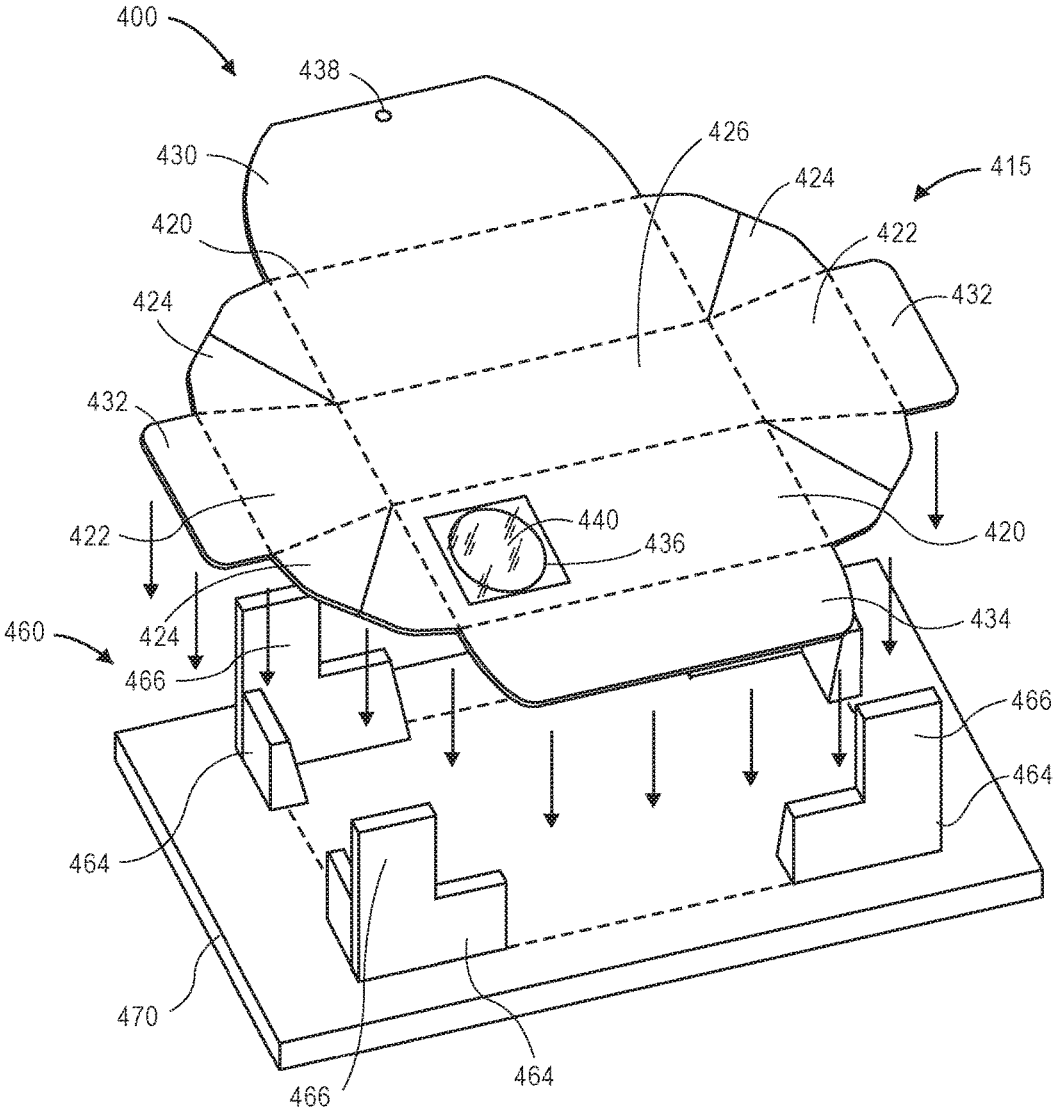

FIG. 4B is a view of a system 400 including the assembly frame 460 of FIG. 4A, and a blank 415 being placed thereon. The blank 415 includes a pair of side panels 420, a pair of end panels 422 and a bottom panel 426. The side panels 420 and the end panels 430 are connected about edges of the bottom panel 426. The blank 415 further includes four corner panels 424 that are connected to and extend between edges of each of the side panels 420 and each of the end panels 422. As is also shown in FIG. 4B, a top panel 430 is connected to an edge of one of the side panels 420, and a top panel 434 is connected to an edge of another of the side panels 420, while top panels 432 are connected to edges of each of the end panels 420. The one of the side panels 420 that is connected to the top panel 434 further includes a window 436 or other opening through which an interior of the cavity 416 may be viewed. The window 436 is covered by a sheet 440 of transparent or translucent material. An adhesive seal 438 (e.g., a piece of double-sided tape of any shape or form) is provided on one surface of the top panel 430.

Figure 4C:
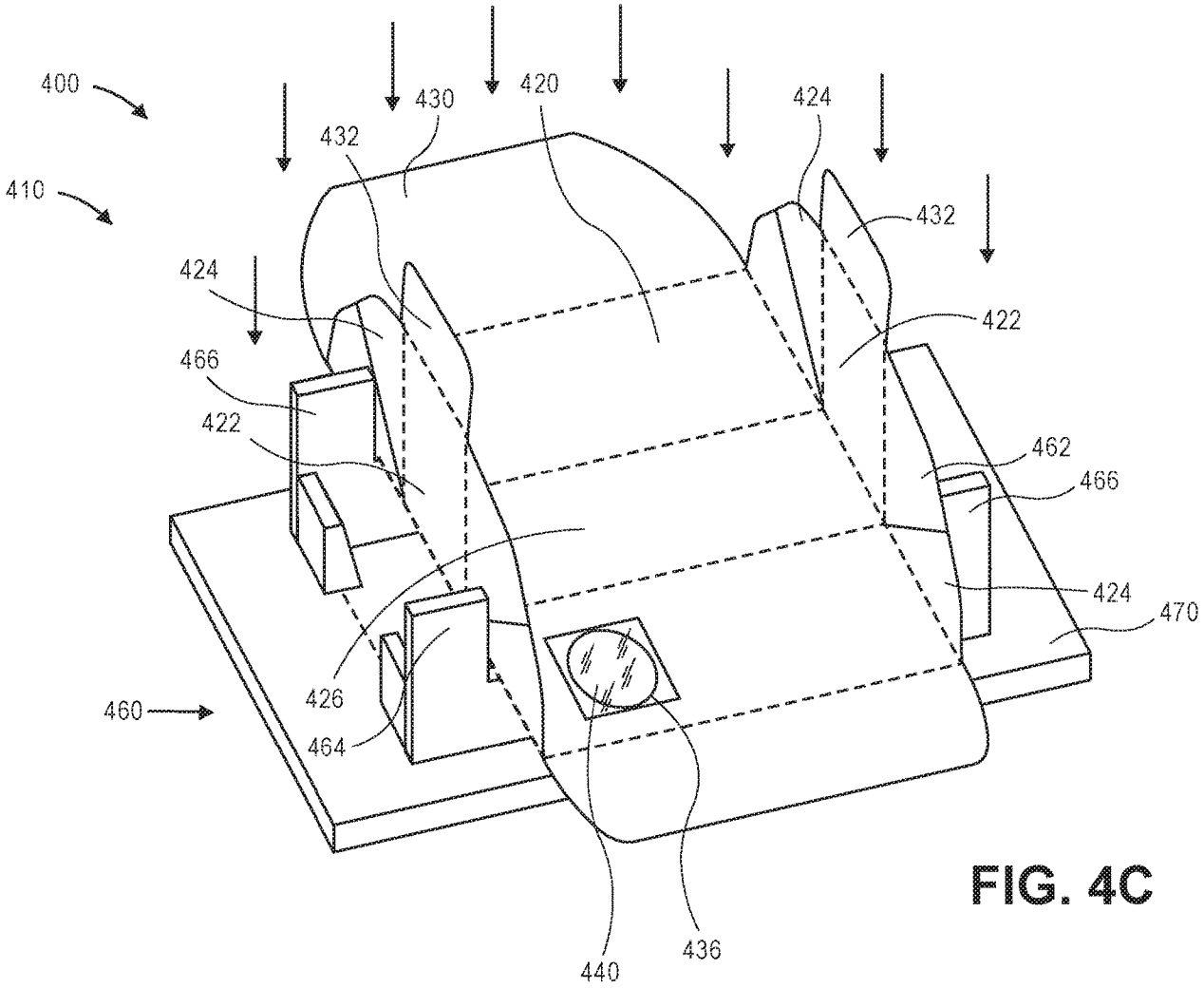

As is shown in FIG. 4B, the blank 415 is being lowered onto the assembly frame 460 in a manner that causes each of the vertical fins 466 to be aligned with one of the corner panels 424. As the blank 415 continues to lower into the assembly frame 460, the bottom panel 426 will descend into a space defined by the inner corners of each of the corner assemblies 462, 464. As is shown in FIG. 4C, the blank 415 has been lowered onto the assembly frame 460, and each of the vertical fins 466 has contacted one of the corner panels 424, to cause the respective corner panels 424, and the end panels 422 to which each is connected, to fold vertically upwardly with respect to the side panels 420 and the bottom panel 426.

Figure 4D:
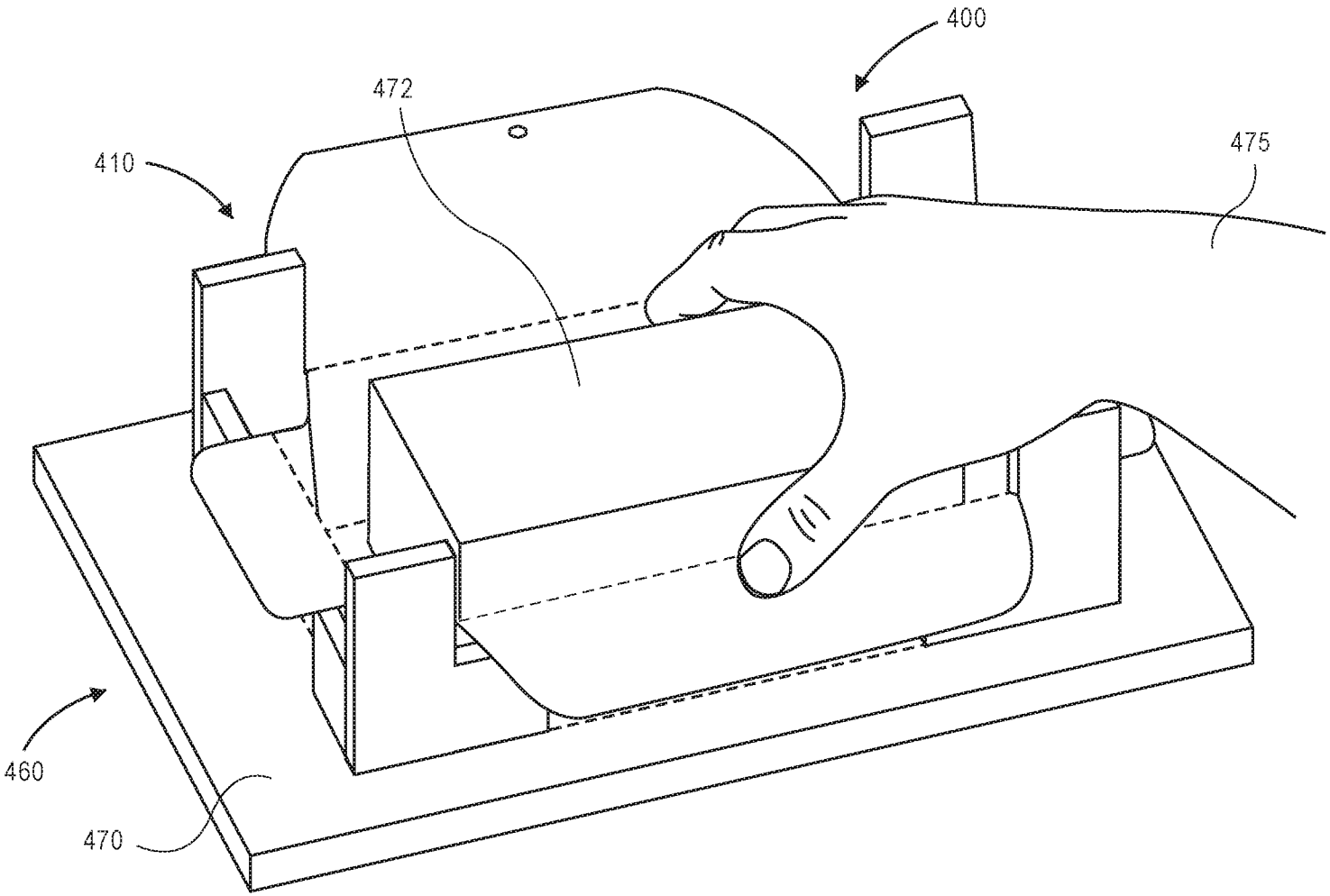

As is shown in FIG. 4D, the blank 415 may be further lowered into the assembly frame 460 using a plunger tool 472, which may be depressed into the blank 415 by a user 475 or, alternatively, by the force of its own weight. The plunger tool 472 may have a shape or form corresponding to the bottom panel 426, or to a volume of a cavity to be formed by the blank 415, or may have any other shape or form. Alternatively, the blank 415 may be further lowered into the assembly frame 460 by a hand of the user 475, or by weight of one or more food products (not shown) to be placed therein.

Figure 4E:
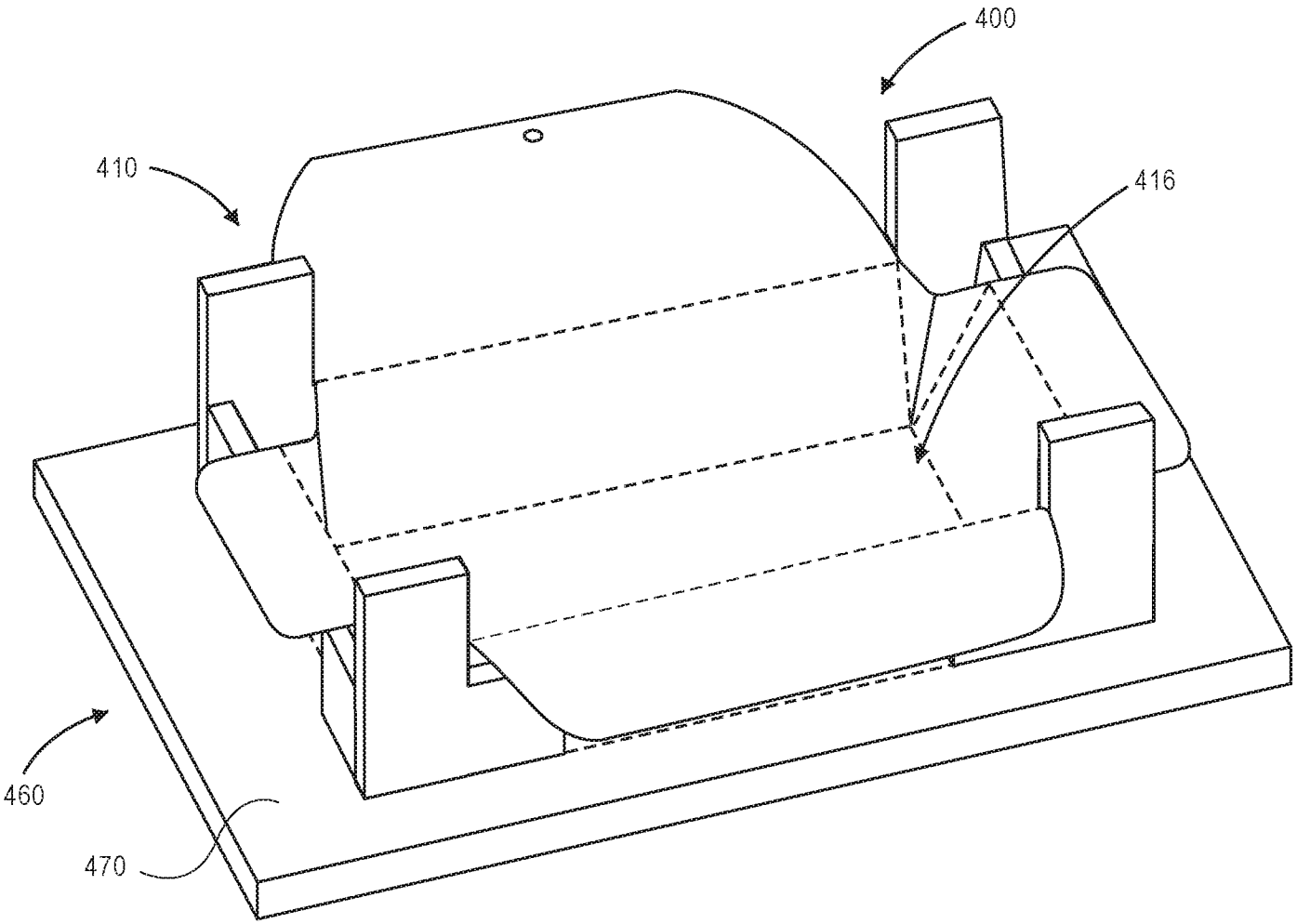

As is shown in FIG. 4E, the blank 415 has been formed into a container 410 resting within the assembly frame 460, e.g., in the space defined by the inner corners of the corner assemblies 462, 464. The container 410 forms a cavity 416 in a semi-folded condition, with the side panels 420 and the end panels 422 each folded upward and the corner panels 424 each folded inward upon contact with the respective vertical fins 466 and corner assemblies 462, 464. Thus, with the container 410 in the condition shown in FIG. 4E, a prepared food product such as a sandwich, a burrito or a cruller may be placed into the container 410, within the assembly frame 460, and the container 410 may be placed into an assembled state and sealed, e.g., by applying the adhesive seal 438 to the top panel 434, or by a rubber band, an elastic band, a piece of masking tape, or any other joining device. Alternatively, a food product may be prepared within the container 410 as is shown in FIG. 4E, and the container 410 may be placed into the assembled state thereafter and sealed.

Figure 5A:
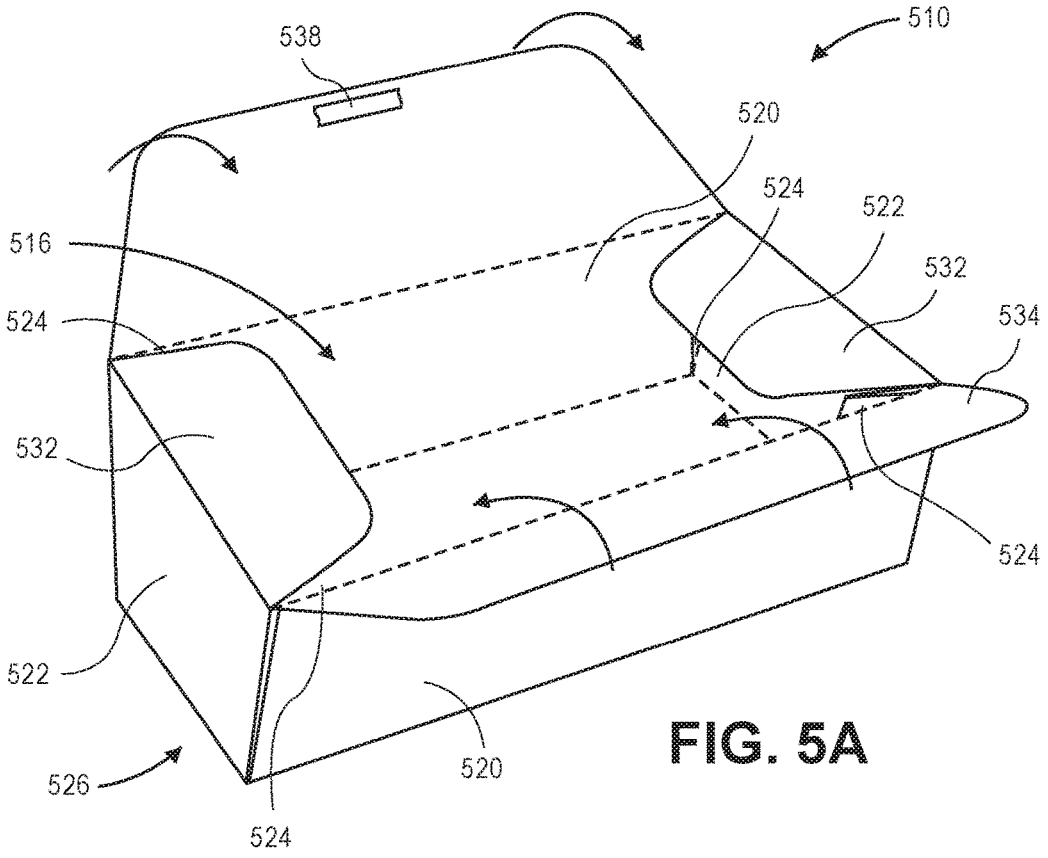
FIGS. 5A and 5B are views of one implementation of a convertible food container in accordance with the present disclosure.
Figure 5B:
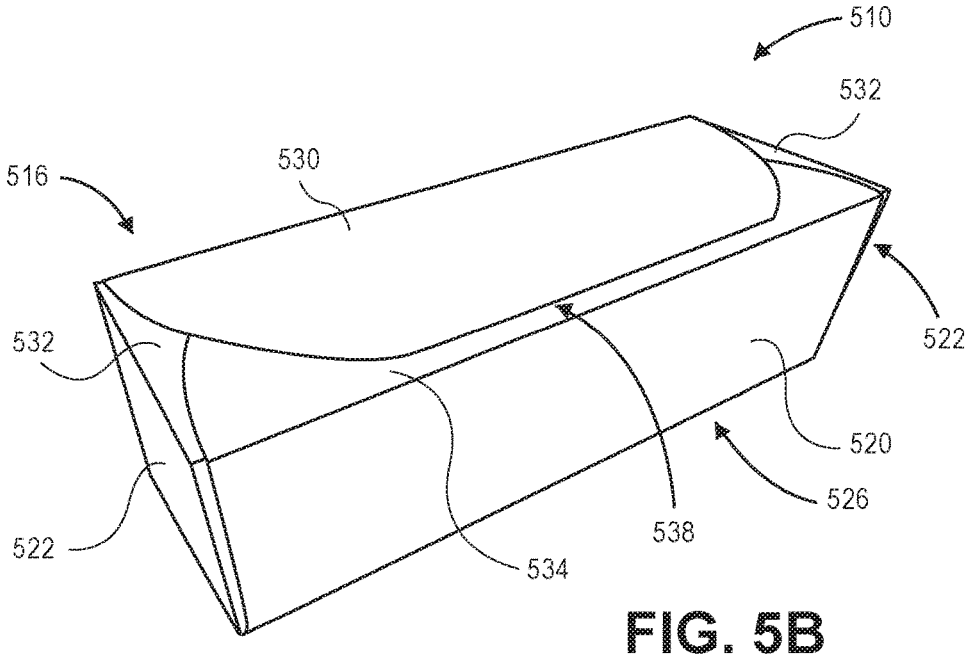

As is discussed above, a convertible food container of the present disclosure may be formed from a blank in a flat state into an assembled state, and retained in the assembled state by any means. Referring to FIGS. 5A and 5B, views of one implementation of a convertible food container in accordance with the present disclosure are shown. Except where otherwise noted, reference numerals preceded by the number "5" shown in FIGS. 5A and 5B indicate components or features that are similar to components or features having reference numerals preceded by the number "4" shown in FIGS. 4A through 4E, by the number "3" shown in FIGS. 3A through 3G, by the number "2" shown in FIGS. 2A through 2G or by the number "1" shown in FIGS. 1A through 1E.

As is shown in FIG. 5A, a container 510 includes a pair of side panels 520, a pair of end panels 522 and a bottom panel 526 defining an internal cavity 516. The container 510 further includes four corner panels 524 extending between each of the side panels 520 and each of the end panels 522. As is also shown in FIG. 5A, the container 510 includes a plurality of top panels 530, 532, 534 that are each connected to edges of the side panels 520 and the end panels 522, and may be folded over the cavity 516 to close the container 510. For example, in order to enclose the container 510 and any food products (not shown) therein, the top panels 532 may be folded over the cavity 516 first, followed by the top panel 534 that is connected to one of the side panels 520, and the top panel 530 that is connected to another of the side panels 520. As is shown in FIG. 5B, after the top panels 530, 532, 534 have been so folded, an inner surface of the top panel 530 may be joined to an outer surface of the top panel 534 by an adhesive tape 538 provided on the top panel 530.

Figure 6A:
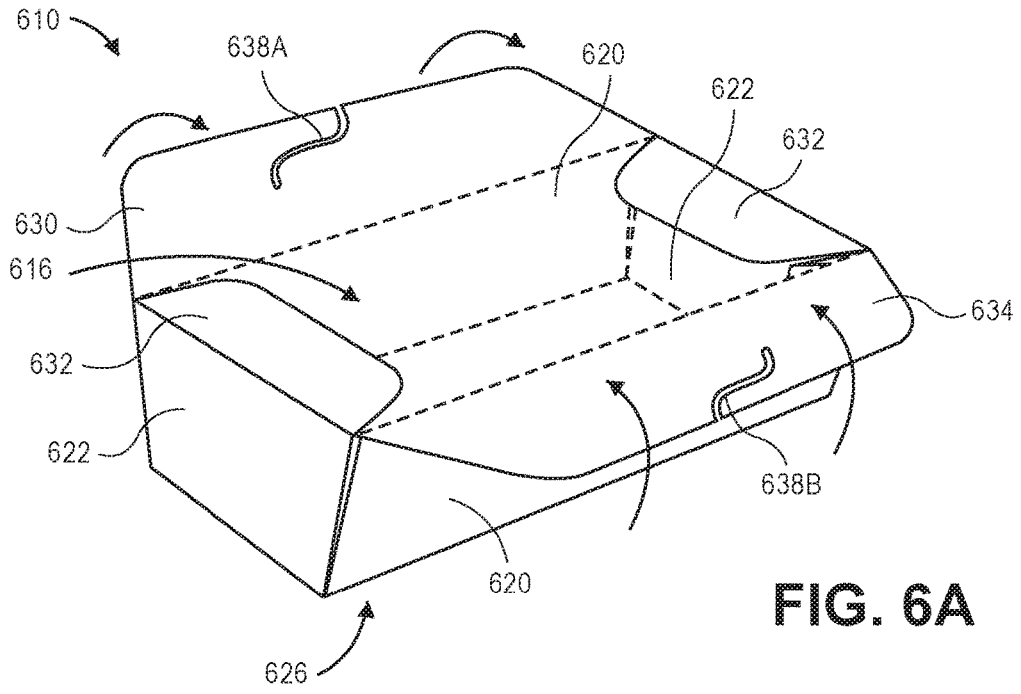
FIGS. 6A and 6B are views of one implementation of a convertible food container in accordance with the present disclosure.
Figure 6B:
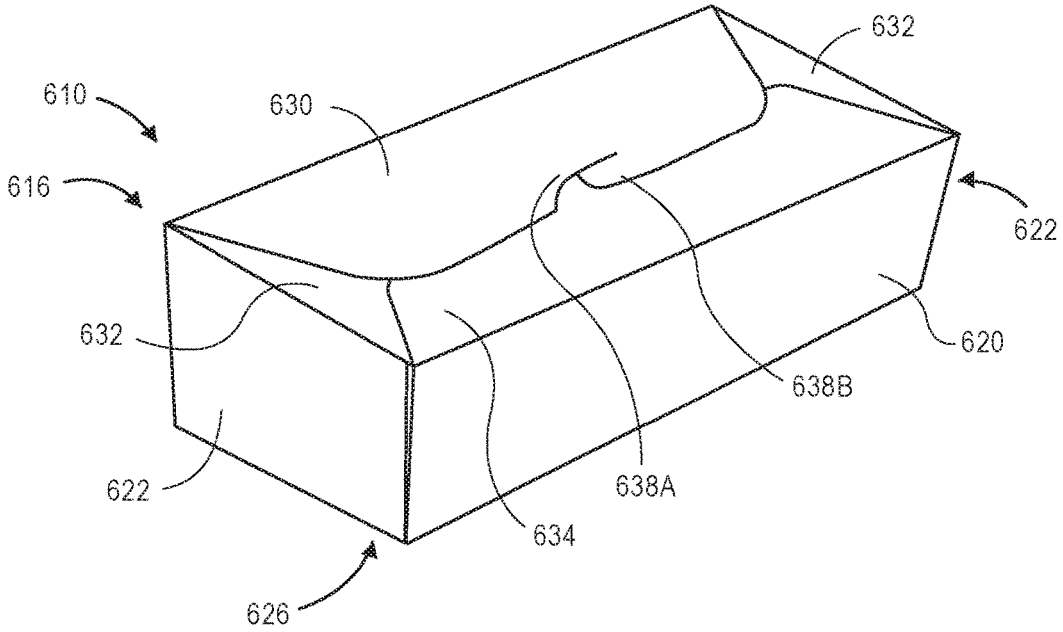

Referring to FIGS. 6A and 6B, views of one implementation of a convertible food container in accordance with the present disclosure are shown. Except where otherwise noted, reference numerals preceded by the number "6" shown in FIGS. 6A and 6B indicate components or features that are similar to components or features having reference numerals preceded by the number "5" shown in FIGS. 5A and 5B, by the number "4" shown in FIGS. 4A through 4E, by the number "3" shown in FIGS. 3A through 3G, by the number "2" shown in FIGS. 2A through 2G or by the number "1" shown in FIGS. 1A through 1E.

The container 610 of FIG. 6A and FIG. 6B is similar to the container of FIGS. 5A and 5B, in that the container 610 includes a plurality of top panels 630, 632, 634 that are each connected to edges of the side panels 620 and the end panels 622, and may be folded over the cavity 616 to enclose the container 610. For example, in order to enclose the container 610 and any food products (not shown) therein, the top panels 632 may be folded over the cavity 616 first, followed by the top panel 634 that is connected to one of the side panels 620, and the top panel 630 that is connected to another of the side panels 620. As is shown in FIG. 6B, after the top panels 630, 632, 634 have been so folded, an extension 638A formed by a slit in the top panel 630 may mate with an extension 638B formed by a corresponding slit in the top panel 634, enabling the container 610 to be enclosed by mechanical interaction between the respective extensions 638A, 638B atop the cavity 616.

Figure 7A:
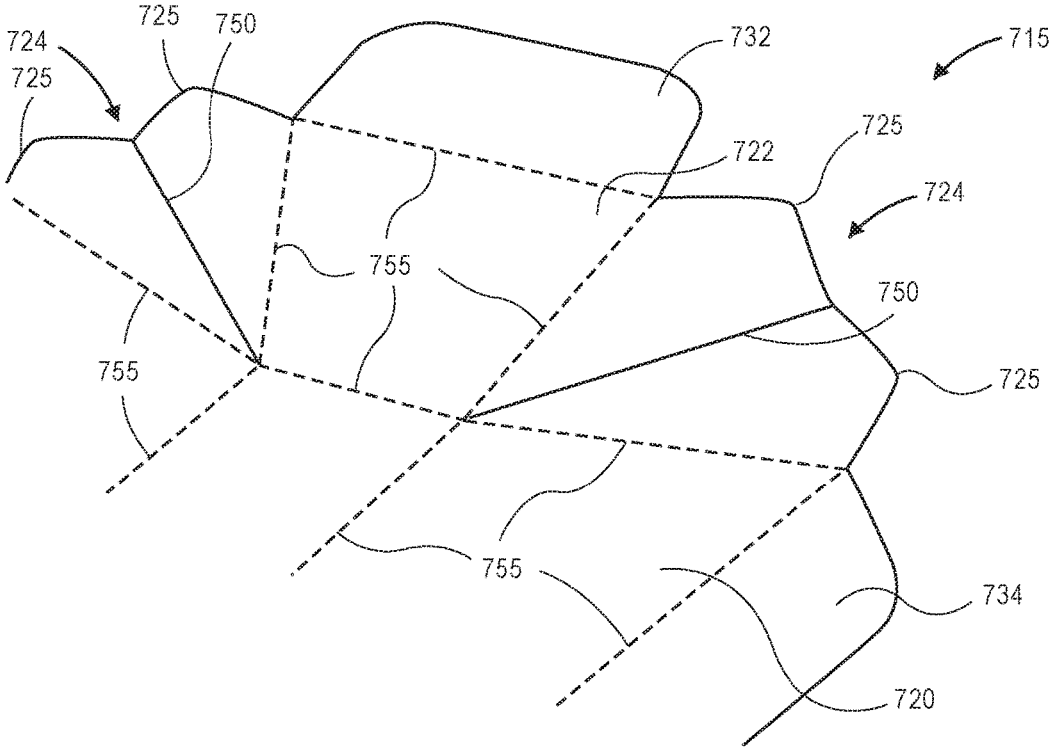
FIGS. 7A and 7B are views of portions of one implementation of a convertible food container in accordance with the present disclosure.
Figure 7B:
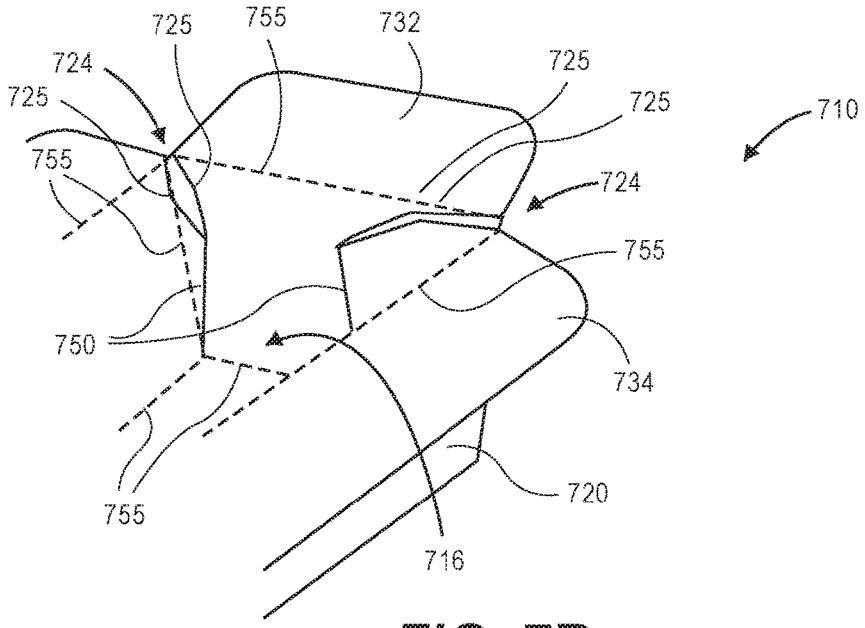

As is further discussed above, side panels and end panels of the present disclosure may be connected to one another via corner panels that may be folded upwardly and inwardly when a blank is formed into a container and unfolded downwardly and outwardly when the container is returned to the blank. Referring to FIGS. 7A and 7B, views of portions of one implementation of a convertible food container 710 in accordance with the present disclosure is shown. Except where otherwise noted, reference numerals preceded by the number "7" shown in FIGS. 7A and 7B indicate components or features that are similar to components or features having reference numerals preceded by the number "6" shown in FIGS. 6A and 6B, by the number "5" shown in FIGS. 5A and 5B, by the number "4" shown in FIGS. 4A through 4E, by the number "3" shown in FIGS. 3A through 3G, by the number "2" shown in FIGS. 2A through 2G or by the number "1" shown in FIGS. 1A through 1E.

FIG. 7A is a perspective view of a portion of a blank 715 having a side panel 720, an end panel 722, and a pair of corner panels 724. A top panel 734 is connected to an upper edge of the side panel 720, and a top panel 732 is connected to an upper edge of the end panel 722.

As is shown in FIG. 7A, each of the corner panels 724 has a shape similar to that of a wedge or a circular sector and is substantially bisected by a scored line 750. Each of the corner panels 724 also features a pair of radial extensions 725 on an outer edge, on opposite sides of the scored line 750. Additionally, locations at which the corner panels 724 are connected to the side panel 720 and the end panel 720, and locations at which the top panels 732, 734 are connected to the end panel 722 and the side panel 720, respectively, are shown with unscored lines 355. Likewise, a rear side or face of the blank 715 (not shown) includes scores or scored lines in locations corresponding to the unscored lines 755 on the front side or face of the blank 715, and may include unscored lines corresponding to the scored lines 750 on the front side or face of the blank 715, in accordance with the present disclosure. The radial extensions 725 are bumps or raised areas of increased height or length within the corner panels 724, as compared to the locations at which the corner panels 724 are connected to the side panel 720 and the end panel 722, respectively, or as compared to a length of the scored line 750. Alternatively, the radial extensions 725 may take any other shape or form, and may be pointed, such as is shown in FIGS. 7A and 7B, as well as rounded, tapered, ribbed, embossed or otherwise formed upon an outer edge of the corner panel 724. For example, in some implementations, the radial extensions 725 may be formed by applying one or more mixtures or substances (e.g., paints, glues or other high-viscosity liquids) to a portion of an outer edge of the corner panel 724 that, after drying, increase both a length and a coefficient of friction of the outer edge of the corner panel 724.

FIG. 7B is a perspective view of a portion of a container 710 formed from the blank 715. As is discussed above, the blank 715 may be formed into a container by drawing the corner panels 724 inward, thereby also bringing the end panel 722 and the side panel 720 inward, to form a container 710 having a cavity 716 therein. The scored lines 750 that bisect the corner panels 724 enable central portions of such panels to be easily folded inward, while scored lines on the rear side or face of the blank 715 (not shown), at the locations of the unscored lines 755 on the front side or face of the blank 715, further enable the corner panels 724 to be easily folded with respect to each of the side panel 720 and the end panel 722. Other scored lines on the rear side or face of the blank 715 (not shown), at other locations of the unscored lines 755 on the front side or face of the blank 715, may further enable the side panel 720 and the end panel 722 to be easily folded with respect to the bottom panel 726, and enable the top panels 732, 734 to be easily folded with respect to the end panel 722 and the side panel 720.

Additionally, the radial extensions 725 on either side of the scored lines 750 on the corner panels 724 further aid the container 710 in remaining in an assembled state. By providing scored lines on the corner panels 724 such as the scored line 750 on the front side or face of the blank 715 as shown in FIG. 7A, or scored lines on the rear side or face of the blank 715 corresponding to the unscored lines 755 on the front side or face of the blank 715 as shown in FIG. 7A, the corner panels 724 each are naturally inclined to unfold and expand into the blank 715.

Thus, when the top panel 732 is folded over the corner panels 724, and the container 710 is closed into the assembled state, e.g., by one or more adhesives such as the adhesive label 142 of FIG. 1A and FIG. 1B or the adhesive tape 538 of FIG. 5A, the extensions 638A, 638B of FIGS. 6A and 6B, or by one or more rubber bands, elastic bands or pieces of masking tape, the radial extensions 725, which have lengths that are longer than lengths of edges or other portions of the corner panels 724 that are connected to the side panel 720 and the end panel 722, or a length of the scored line 750, provide increased friction against undersides of the top panel 732, thereby resisting the natural inclination to unfold and expand into the blank 715, as long as the top panel 732 remains over the radial extensions 725. Once the top panel 732 is removed therefrom, however, the container 710 will be naturally urged from an assembled state into a flat state, e.g., into the blank 715 shown in FIG. 7A.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure. For example, although some of the implementations of blanks and containers of the present disclosure are described herein in connection with the enclosure and consumption of prepared foods, those of ordinary skill in the pertinent arts will recognize that the present disclosure is not so limited, and that the blanks and containers may be provided in connection with the transportation and use of inedible products of any kind.

Moreover, the blanks and containers of the present disclosure may be used in any type or form of facility, and are not limited in their application or implementation to facilities where foods are prepared and packaged.

Although some of the implementations of blanks and containers disclosed herein are referenced as being made from paperboard or cardboard, those of ordinary skill in the pertinent arts will recognize that the present disclosure is not so limited. The blanks and containers may be made from any suitable material, e.g., materials having one or more natural or synthetic fibers such as paper, plastic or fabric fibers, and may be provided with or without oil and grease resistant coatings. Additionally, although some of the embodiments are shown as having side panels that are longer than end panels, the blanks and the container formed therefrom may have any length or shape (e.g., squares or other polygons) in accordance with the present disclosure.

It should be understood that, unless otherwise explicitly or implicitly indicated herein, any of the features, characteristics, alternatives or modifications described regarding a particular implementation herein may also be applied, used, or incorporated with any other implementation described herein, and that the drawings and detailed description of the present disclosure are intended to cover all modifications, equivalents and alternatives to the various implementations as defined by the appended claims. Moreover, with respect to the one or more methods or processes of the present disclosure described herein, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain implementations could include, or have the potential to include, but do not mandate or require, certain features, elements and/or steps. In a similar manner, terms such as "include," "including" and "includes are generally intended to mean "including, but not limited to." Thus, such conditional language is not generally intended to imply that features, elements and/or steps are in any way required for one or more implementations or that one or more implementations necessarily include logic for deciding, with or without user input or prompting, whether these features, elements and/or steps are included or are to be performed in any particular implementation.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain implementations require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative implementations thereof, the foregoing and various other additions and omissions may be made therein and thereto without departing from the spirit and scope of the present disclosure.

What is claimed is:

1. A container comprising:

a paperboard blank comprising:

a bottom panel;

a first side panel, wherein the first side panel is connected to the bottom panel at a first bottom edge, connected to a first corner panel at a first front edge, connected to a second corner panel at a first rear edge, and connected to a first top panel at a first top edge;

a second side panel, wherein the second side panel is connected to the bottom panel at a second bottom edge, connected to a third corner panel at a second front edge, connected to a fourth corner panel at a second rear edge and connected to a second top panel at a second top edge;

a first end panel, wherein the first end panel is connected to the bottom panel at a third bottom edge, connected to the first corner panel at a first side edge, connected to the third corner panel at a second side edge and connected to a third top panel at a third top edge; and a second end panel, wherein the second end panel is connected to the bottom panel at a fourth bottom edge, connected to the second corner panel at a third side edge, connected to the fourth corner panel at a fourth side edge, and connected to a fourth top panel at a fourth top edge, wherein the first side panel is folded upwardly at the first bottom edge with respect to the bottom panel, wherein the second side panel is folded upwardly at the second bottom edge with respect to the bottom panel, wherein the first end panel is folded upwardly at the third bottom edge with respect to the bottom panel, wherein the second end panel is folded upwardly at the fourth bottom edge with respect to the bottom panel, wherein the first side panel, the second side panel, the first end panel, the second end panel and the bottom panel define a cavity, wherein a first score substantially bisects the first corner panel on a front face of the paperboard blank, wherein a second score is provided on a rear face of the paperboard blank and at the first front edge of the first side panel, wherein a third score is provided on the rear face of the paperboard blank and at the first side edge of the first end panel, wherein the first corner panel comprises a first radial extension provided between the first score and the second score, wherein the first corner panel further comprises a second radial extension provided between the first score and the third score, wherein each of the first radial extension and the second radial extension has a first length, wherein each of the first score, the second score and the third score has a second length, wherein the first length is greater than the second length, wherein the first corner panel is folded into the cavity at the first front edge of the first side panel and at the first side edge of the first end panel, wherein the second corner panel is folded into the cavity at the first rear edge of the first side panel and at the third side edge of the second end panel, wherein the third corner panel is folded into the cavity at the second front edge of the second side panel and at the second side edge of the first end panel, wherein the fourth corner panel is folded into the cavity at the second rear edge of the second side panel and at the fourth side edge of the second end panel, wherein the first top panel is folded over the cavity at the first top edge of the first side panel, wherein the second top panel is folded over the cavity at the second top edge of the second side panel, wherein the third top panel is folded over the cavity at the third top edge of the first end panel, wherein the fourth top panel is folded over the cavity at the fourth top edge of the second end panel, and wherein at least one of the first top panel or the third top panel is in contact with at least one of the first radial extension or the second radial extension.

2. The container of claim 1, further comprising an adhesive label joining at least the first top panel and the second top panel over the cavity, wherein the adhesive label further comprises at least one of:

a name of a food product within the cavity;

a price of the food product within the cavity; or a machine readable marking encoded with information associated with the food product within the cavity; and wherein the third top panel and the fourth top panel are folded over the cavity below at least a portion of the first top panel and at least a portion of the second top panel.

3. A blank comprising:

a first side panel;

a second side panel;

a first end panel;

a second end panel;

a bottom panel;

a first corner panel between the first side panel and the first end panel, wherein the first corner panel comprises a first radial extension, a second radial extension, a first edge connected to a second edge of the first side panel, and a third edge connected to a fourth edge of the first end panel;

a second corner panel between the first end panel and the second side panel;

a third corner panel between the second side panel and the second end panel;

a fourth corner panel between the second end panel and the first side panel;

a first score between the first edge and the second edge, wherein the first score extends from an intersection of a first side of the bottom panel and a second side of the bottom panel to an open edge of the first corner panel, and wherein the first score is provided on a rear face of the blank;

a second score substantially bisecting the first corner panel, wherein the second score extends from the intersection of the first side of the bottom panel and the second side of the bottom panel to the open edge of the first corner panel, and wherein the second score is provided on a front face of the blank, and wherein the first radial extension and the second radial extension are provided on opposite sides of the second score;

a third score between the third edge and the fourth edge, wherein the third score extends from the intersection of the first side of the bottom panel and the second side of the bottom panel to the open edge of the first corner panel, and wherein the third score is provided on the rear face of the blank;

a first top panel having a bottom edge connected to a top edge of the first end panel at a fourth score;

a second top panel having a bottom edge connected to a top edge of the second end panel at a fifth score;

a third top panel having a bottom edge connected to a top edge of the first side panel at a sixth score; and a fourth top panel having a bottom edge connected to a top edge of the second side panel at a seventh score, wherein each of the first radial extension and the second radial extension has a first length, wherein each of the first edge, the second edge, the third edge and the fourth edge has a second length, wherein the first length is greater than the second length, and wherein at least one of the first top panel or the third top panel is configured to contact one of the first radial extension or the second radial extension when the first corner panel and the first side panel are folded about the first score, when the first corner panel is folded about the second score, when the first corner panel and the first end panel are folded about the third score, when the first top panel and the first end panel are folded about the fourth score, and when the third top panel and the first side panel are folded about the sixth score.

4. The blank of claim 3, wherein each of the first score, the second score and the third score is one of a cut, a crease, a groove, a perforation or a ridge provided on at least one of the front face of the blank or the rear face of the blank.

5. The blank of claim 3, wherein one of the first side panel or the second side panel comprises an opening cut therein.

6. The blank of claim 3, wherein the opening is covered by a translucent layer adhered to the one of the first side panel or the second side panel.

7. The blank of claim 3, further comprising an adhesive seal provided on a front face of one of the third top panel or the fourth top panel.

8. The blank of claim 3, wherein the first end panel is substantially trapezoidal in shape and comprises a first bottom edge connected to the bottom panel at a first score, and wherein the first side panel is substantially rectangular in shape and comprises a second bottom edge connected to the bottom panel at a second score.

9. The blank of claim 3, wherein the blank is a cellulose-based material having a thickness of approximately eighteen one-hundredths of one inch.

10. The blank of claim 9, wherein the cellulose-based material comprises at least one of a card stock, a corrugated fiberboard, a white board, a solid board, a chipboard or a fiberboard.

11. The blank of claim 3, wherein a front face of the blank is lined with a grease-resistant coating.

* * * * *